United States Patent [19]

Donovan

[11] 4,270,437

[45] Jun. 2, 1981

[54] GAS OPERATED AUTOMATIC WEAPON

[76] Inventor: John S. Donovan, 16503 Santa Rosa, Detroit, Mich. 48221

[21] Appl. No.: 20,679

[22] Filed: Mar. 15, 1979

Related U.S. Application Data

[63] Continuation-in-part of Ser. No. 916,961, Jun. 19, 1978, abandoned, which is a continuation-in-part of Ser. No. 874,114, Feb. 1, 1978, Pat. No. 4,210,060, which is a continuation-in-part of Ser. No. 829,716, Sep. 1, 1977, abandoned.

[51] Int. Cl.[3] ..... F41D 5/04

[52] U.S. Cl. ..... 89/192; 89/33 C

[58] Field of Search ..... 89/33 BB, 33 C, 192

[56] References Cited

U.S. PATENT DOCUMENTS 3,853,035 12/1974 Donovan ..... 89/33 C

*Primary Examiner*—Stephen C. Bentley

*Attorney, Agent, or Firm*—John R. Benefiel

[57] ABSTRACT

A belt-fed, gas operated automatic weapon of a type in which the gas pressure developed in the bore is ported just forward of the chamber and utilized to compress a system of opposing spring sets which in turn operate the various mechanisms involved in the automatic or semi-automatic functioning of the weapon. Symmetrically arranged dual power cylinders operated by the gas pressure compress all of the springs in the opposing spring sets by engagement with a sliding carriage. Bolt locking is carried out by a separate oscillating cam-operated bolt latch element cooperating with a shoulder recess formed in the periphery of the bolt, with an arrangement for reducing the bolt locking mechanism forces during the unlocking interval. Manual actuation is enabled by movement of a slider. The bolt is automatically latched open in some modes of operation. A particular interlinked ammunition belt construction is disclosed to separate each link from the belt after passing beyond the bolt.

10 Claims, 29 Drawing Figures

206
212
208
204
214
220
210
34
216

524
502
506
177
508
173
504
526
34
172
66
171
68

130
126
62
36
34
36
60
60
132
128

98
24
106
98
34
94
110
108
177
108
112

184
286
184
288

185
188
187
186
225
227
225

152
44
456
454
276
154
252
250
274

152
44
456
454
276
154
248
203
205
274
276

66
480
482
424
426
68

44
456
454
166
164
177
248
246
22

386
394
396
388
376

382
392
374
390
384
373
375
377

150
189
175
199
203
197B
177
197A
205
420
422
229
225
227
225
176
201
211
221
211
219
195
193
217
215
219
207
209
209

156
160
151
150
177
180
176
178
182
170
166
158
168
162
197A
197B
278
280
230
204
175
250
252
84
214
212
210
282
285
284
238
240
232
218
324
328
326
226
224
266
268
326
228
308
254
314
256
234
242
316
294
262
244
236
306
310
258
264
312
304
260
302
296
300
270
298
272
328
330

360
362
370
346
204
358
230
308

360
356
230
362
370
204
404
346
308

360
356
230
362
204
370
346
368
308

GAS OPERATED AUTOMATIC WEAPON

CROSS REFERENCE TO RELATED APPLICATIONS

This application is a continuation-in-part of Ser. No. 916,961, filed June 19, 1978, now abandoned, which is a continuation-in-part of Ser. No. 874,114, filed Feb. 1, 1978, now U.S. Pat. No. 4,210,060 which is in turn a continuation-in-part of Ser. No. 829,716, filed Sept. 1, 1977, now abandoned.

BACKGROUND DISCUSSION

This invention concerns automatic weapons and more particularly is concerned with improvements in gas operated automatic weapons.

Infantry squad, platoon and company level operations often require the fire power of fully automatic weapons with rates of fire as is presently afforded by the belt-fed, tripod-mounted machine guns. The fully automatic capability of the basic shoulder weapon of many modern armies does not satisfactorily fulfill this requirement since these weapons are generally magazine fed and hence cannot provide this level of fire power on a sustained basis.

In addition, these weapons generally are not effective in the fully automatic mode of fire since the rates of fire and the design of these particular weapons is such that it is impossible to effectively direct the fire after the initial few rounds.

The belt-fed, tripod-mounted machine gun, while suitable for defensive situations, is ill-adapted to assault or offensive operations due to its weight and bulk, even when refitted for shoulder fire. Furthermore, the use of such weapon is complicated from a military logistics standpoint since these weapons are only issued on an organizational unit basis, i.e., each company or platoon is issued a predetermined number of such weapons and a limited number of trained gunners are assigned to each unit. This creates a logistics problem since the need for such automatic weapon fire power varies with the given tactical situation.

It would thus be advantageous if such automatic weapons capability could be afforded to each infantry unit on a more flexible basis and such logistics problems could be eliminated.

Such capability could be provided by a shoulderfired, belt-fed semi-automatic weapon which was light in weight and could be fired with sufficient accuracy such that such weapons could be issued to each infantryman at the squad level as the basic weapon, with a ready conversion to automatic firing providing a tremendous enhancement of the fire power of the infantry unit.

Such a firearm would necessarily be required to meet certain additional essential or highly desirable design criteria for military weaponry. For example, such weapons must be very reliable and readily field stripped in order to correct any malfunctioning which may occur without the use of tools. An example of a highly desirable feature is a capability for right or left handed firing of the weapon in many military operations, particularly in operations conducted through urban areas. That is, the feeding of belt-carried ammunition should be able to be done from either side since the tactics of the situation often involve firing from concealed positions against a building wall on either side of the street.

In U.S. Pat. Nos. 3,776,096 and 3,853,035, both issued to the present inventor, is disclosed such a shoulderfired automatic weapon which is gas operated as are many such automatic weapons. However, in the design disclosed therein, the gas porting is located just ahead of the barrel chamber such that relatively high pressure gas is utilized to operate the various mechanism to obtain advantages over those conventional designs which are operated by gas pressure ported at the forward point along the weapon barrel. The major drawback of the conventional designs is that they necessitate long operating rods extending forwardly to the gas port, increasing the bulk and weight of the weapon and adversely affecting its balance characteristics.

This specific advantage of the design disclosed in those patents is afforded without the necessity for the use of gas pressure accumulator devices to reduce excessive forces which would otherwise be created. This is done by a unique concept, in which the sequencing of operation is not carried out directly by the movement of an operating rod, but rather there is provided a sequential operation of the associated automatically-operated mechanisms which are operated by means of opposing sets of springs, in turn compressed by means of the gas pressure applied to pistons such that the accumulator mechanisms are not necessitated. All of the operating components thereby may be located to the rear of the weapon, and the resulting weapon is of relatively light weight and of excellent balance. It is thus rendered suitable for issuance to infantrymen as the basic shoulder-fired weapon, while affording the fire power inherent in a belt-fed fully automatic firearm.

In this design, as in any firearm, it would of course be desirable to reduce the deflections and stresses produced in the various operating parts so as to enable minimization of the size and mass of the various components to further enhance the handling advantages of the design.

While a dual piston operating rod assembly for a gas operated automatic firearm is disclosed in U.S. Pat. No. 3,999,461, this weapon design involves a forwardly located gas port requiring a significant mass of the weapon to lie forward of the receiver of the weapon, leading to the aforementioned disadvantages. In addition, each of the piston members performs different functions in the operation of the weapon such that true symmetry and balancing of forces is not achieved, albeit some reduction in the stress levels exerted on the components is achieved.

The manual actuation of the weapon disclosed in the above-cited patents to the present inventor is relatively cumbersome and it would likewise be advantageous to simplify the manipulations required in executing a manual actuation of the weapon.

The weapon disclosed in those patents also produces a relatively high pressure sliding movement by virtue of the design feature wherein the bolt is locked during firing by means of an oscillating bolt latch element, which is operated to release the bolt while the bolt was urged to retract under heavy pressure by a compressed spring in the opposing spring system. This arrangement obviously would produce a wear point in the mechanism, and it would be advantageous if such presssure could be relieved at least partially during the cycling of the bolt latch element.

Another capability which would be desirable in such weaponry is the automatic retention of the bolt in its fully retracted position during manual operation and also after the cessation of automatic fire, since this allows the ammunition belt to be removed from the breech, a fresh belt to be inserted, or to leave the breech clear to free a jammed cartridge, or to allow cooling of the chamber.

All of such improvements are described in the above-identified pending patent application Ser. No. 874,114, in which the bolt locking mechanism is unloaded during its operation, involving the use of a mass which is momentarily accelerated by compression springs in the interval of bolt unlocking. However, the mass is located in a relatively confined space and requires a material of very high density to provide the required mass for proper operation. This creates a critical design point in insuring the proper operation.

In addition, in the arrangement disclosed, the method of operating the feed trays utilized to advance the ammunition belt through the receiver relies on the use of spring forces exerted by a feed leaf spring.

While this approach is valid, the use of a more positive actuation would be desirable in such a critical part of the operating mechanism in which the relatively massive and non-precision formed belt links must be reliably advanced.

The feed trays themselves are of a relatively complicated configuration in the latter of the applications, due to the inward bias applied to these components throughout their stroking movement and could be advantageously simplified.

Accordingly, it is an object of the present invention to provide an arrangement for providing an inertia mass in the weapon design disclosed in the above-referenced pending patent application in which the bulk thereof may be considerably increased, allowing the component element to be formed from steel, while insuring reliable operation of the mechanism.

It is still another object of the present invention to provide a feed mechanism for this weapon design which actuates the movement of the feed trays in a more positive manner and in which the configuration of the feed trays is simplified.

It is still another object of the present invention to provide certain other design improvements to the gas operated automatic weapon described in the above-referenced pending patent application to certain of the feed mechanism components as will be described hereinafter.

SUMMARY OF THE INVENTION

These and other objects of the present invention, which will become apparent upon a reading of the following specification and claims, are accomplished by a feed arrangement which includes a parallel strap linkage operated by a relatively massive feed slider slidably mounted in the receiver housing which also acts as the "hesitator" mass during unloading of the bolt mechanism by the compression spring. The in-and-out movement of the parallel linkage is positively executed by the reciprocation of the feed slider.

The carriage latching is carried out by turned-in tips of rearwardly extending ends of a wound spring positioned within a recess in the receiver and into the path of a catch tab formed on the side of the carriage. The carriage moves between the turned-in tips, spreading them apart, and is latched against forward movement upon moving to the rear of the tips by moving back into a grooved surface of the catch tab.

The wound spring is carried by the parallel linkage and caused to be wound by out movement of the parallel linkage and forces a feed tray operator fork out upon release of the wound spring from the carriage by rearward movement of the bolt during the reloading cycle.

The movement of the feed tray operator fork causes reciprocation of the feed trays which cooperate with an ammunition belt to feed the ammunition.

The feed trays operate by a squeeze bias arrangement which acts only as the trays move into gripping engagement with the next successive ammunition link.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
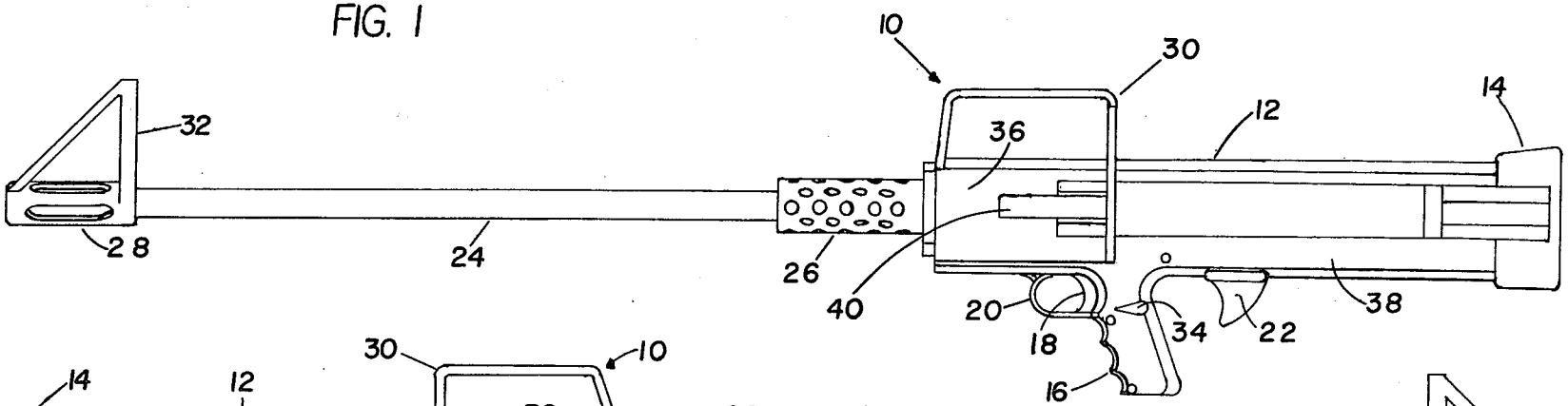
FIG. 1 is a side elevational view of the automatic weapon according to the present invention.
Figure 2:
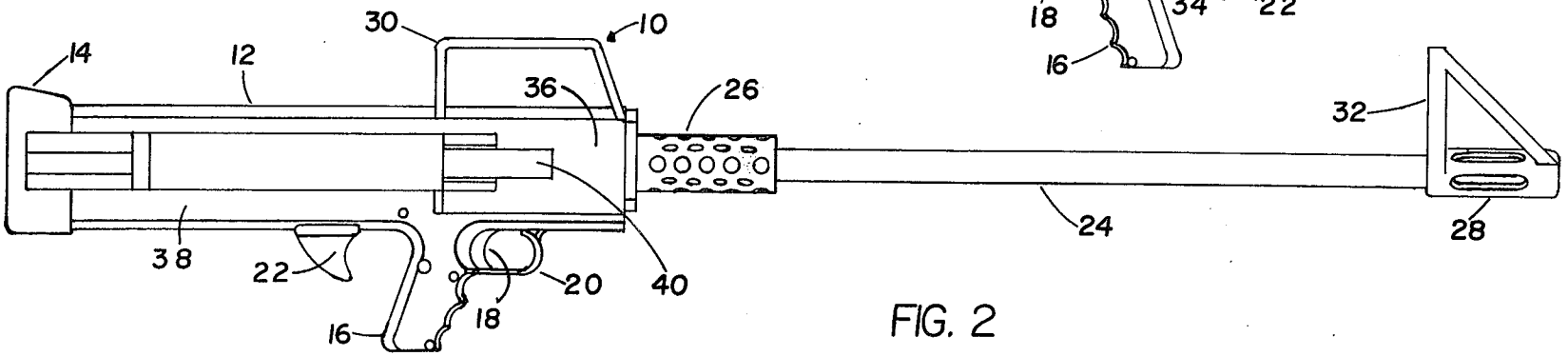
FIG. 2 is the reverse side elevational view of the automatic weapon shown in FIG. 1.

Referring to FIGS. 1 and 2, the basic external configuration of the automatic weapon 10 according to the present invention can be seen and includes a housing 12 which encloses the weapon, including a butt 14 adapted to engage the shoulder of the firer. A hand grip 16 is provided, as is a trigger 18 and a trigger guard 20.

A manual actuation slider 22 is provided for manually cycling the operating mechanism, the slider 22 disposed for sliding movement along the bottom of the housing 12.

The barrel 24 extends forwardly from the housing 12 and is equipped with a heat shield 26 adapted to protect the firer from the high temperature portion of the barrel 24 in the vicinity of the firing chamber as well as to aid in the dissipation of heat. A flash suppressor 28 is provided at the forward end of the barrel 24, while the rear sight bracket 30 and a front sight 32 are also provided. Other conventional accessories such as carrying straps, bipod mounts, etc., are not shown, but the weapon would normally be equipped or adapted to be equipped for such standard military accessories.

A selector lever 34 is provided which is used to selectively cause the weapon to fire in the automatic or the semi-automatic mode and further acts as a safety depending on the rotative position and also allows by proper positioning of the selector lever 34 that the bolt may be retained in the rearward position upon cessation of automatic fire.

The housing 12 is comprised of two cover plates of formed sheet metal, an upper-forward cover plate 36 generally extending over the top portion of the housing 12 and a rear lower cover 38 similarly formed of sheet metal, with the upper front cover 36 and the lower rear cover 38 abutting each other along the lower portion of the housing 12, forward of the trigger guard 20. The lower rear cover also is formed into a hand grip 16 as best seen in FIGS. 8 and 9.

Figures 3, 4, 5:
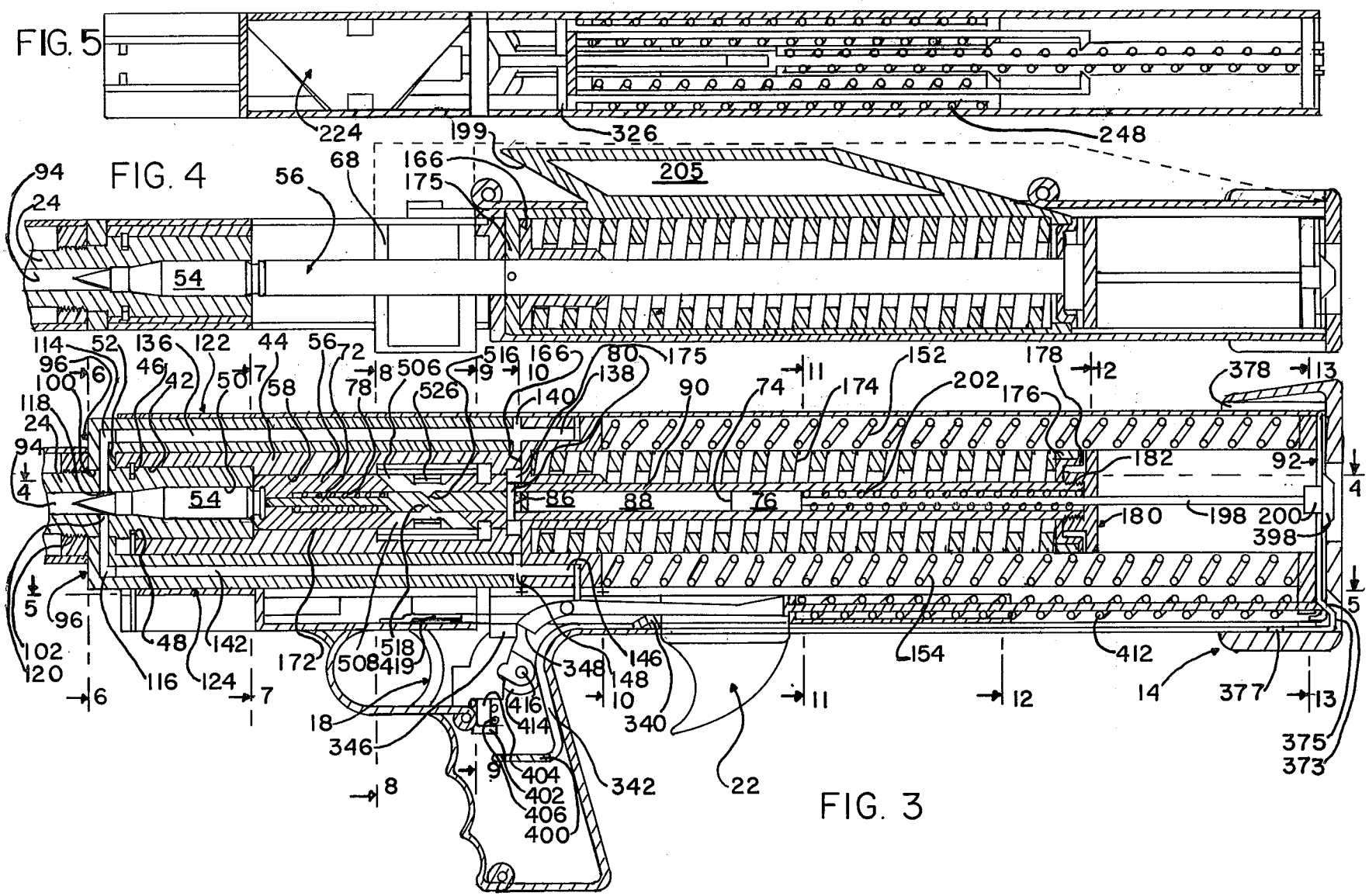
FIG. 3 is a longitudinal partially sectional view of the automatic weapon shown in FIGS. 1 and 2 with the forward sections of the barrel broken away.
FIG. 4 is a horizontal sectional view of the line 4—4 in FIG. 3.
FIG. 5 is a horizontal sectional view taken through the plane represented by the line 5—5 in FIG. 3.

Barrel 24 is assembled into a barrel housing bore 42 formed in a receiver frame 44 as best seen in FIG. 3 with a snap ring retainer 46 seated in a recess 48 machined around the outside diameter of the barrel 24 in the region of the chamber 50. The snap ring retainer 46 locates an end face 52 of the receiver frame 44 to retain the barrel 24 within the bore 42. The barrel chamber 50 is machined in the conventional fashion to receive a cartridge 54 shown seated in the chamber 50. A cartridge 54 is locked in position within the chamber 50 by means of a bolt assembly 56 slidably disposed within slot 58 also formed in the receiver frame 44.

The bolt assembly 56 functions in a broadly conventional manner to securely position the cartridge 54 in position during firing when the bolt 56 is locked in the position shown in FIG. 3 by a bolt locking mechanism to be described. This allows the bolt assembly 56 to absorb the heavy forces generated by the gas created by firing of the cartridge 54, which pressures persist until the bullet passes entirely out of the barrel 24 allowing the gases therein to vent.

Figures 6, 7, 8, 9:
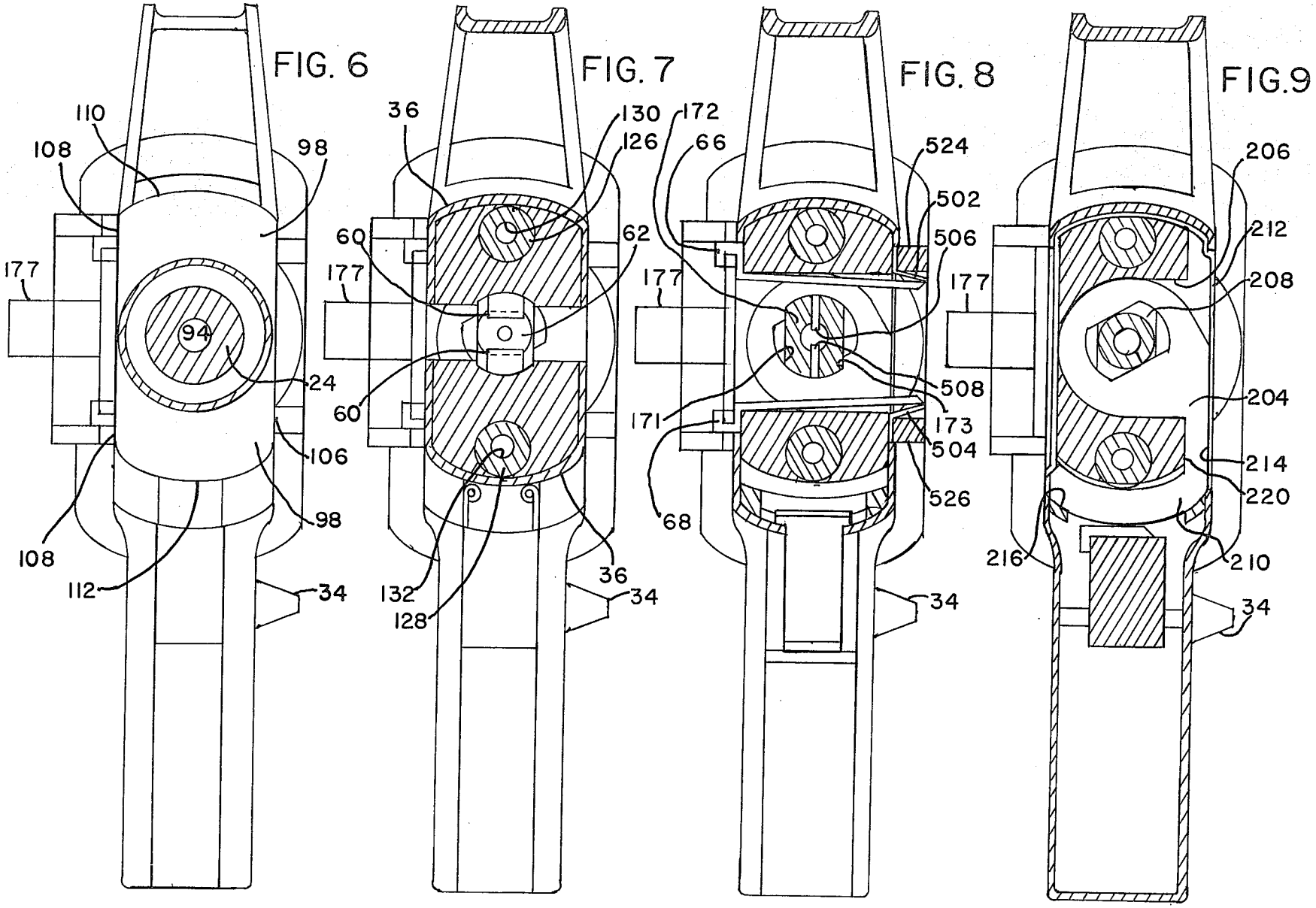
FIG. 6 is a view of the section 6—6 taken as indicated in FIG. 3.
FIG. 7 is a view of the section 7—7 taken as indicated in FIG. 3.
FIG. 8 is a view of the section 8—8 taken as indicated in FIG. 3.
FIG. 9 is a view of the section 9—9 taken as indicated in FIG. 3.

The bolt assembly 56 also engages the cartridge 54 to ram each round of ammunition into the chamber 50 as well as to extract the expended shell casing after firing by means of a pair of grooves 60 recessed into the bolt face 62 (FIG. 7). Each cartridge 54 is adapted to be fed into the receiver frame 44 through a breech opening 40 (FIG. 1), when the bolt 56 is in the retracted position as will be described by means of a pair of ammunition feed trays 66 and 68 which in turn are reciprocated by means of feed mechanisms also to be described herein. The cartridges 54 are carried by an interlinked ammunition belt into the breech opening 40 (FIG. 1) on trays 66 and 68 (FIG. 16) with the expended shell casing being again placed within the links of the ammunition belt and fed out of the receiver through a breech opening 40 (FIG. 2) in the receiver frame 44.

A centrally disposed firing pin 72 is also provided which is positioned within a central opening in the bolt 56, arranged so as to impact the primer of the cartridge 54 in the conventional manner upon being struck by the impacting of the head 74 of a hammer mechanism 76, triggering being controlled differently in the automatic firing than in semi-automatic firing modes as will be described hereinafter.

The firing pin 72 is returned to its initial position after firing by means of a return spring 78 with a pin connection 80 being provided passing through a perpendicular bore in the rear shank of the firing pin, the clearance space 86 being provided to allow forward movement of the firing pin 72 upon impact of the hammer head 74, but insuring that the firing pin 72 is moved with the bolt assembly 56 during its movement in cycling of the weapon mechanism.

The hammer head 74 passes down through a long bore 88 formed in the rear extension portion 90 integral with the bolt 56, the hammer head portion 74 being slidably disposed in the rear portion of the interior bore 88 as shown in FIG. 3.

The release of the hammer 76 is controlled by a sear mechanism 92 located within the rifle butt 14 which sear mechanism was described in the above-cited patents, but for the sake of completeness, the details of this mechanism will be described herein.

According to the concept of the present invention, the various mechanism arrangement of parts required for ammunition feeding, bolt locking and unlocking and the bolt movements required for extraction, and ramming of each round into and out of the barrel chamber, respectively, are operated by means of a gas pressure generated in the rifled bore 94 of the barrel 24 by burning of the cartridge charge after ignition by the cartridge primer. This gas pressure is converted into a mechanical force by means of a dual power cylinder assembly 96 (FIG. 3) which includes a manifold end plate 98 (FIG. 6) slidably disposed over the outside of the barrel 24, seated on a shoulder 100 (FIG. 3) and retained thereon by means of a threaded ring 102 mated to a threaded portion machined around the barrel 24 as shown in FIG. 3. The manifold end plate 98 (FIG. 6) is formed with flattened sides 106 and 108 with partially circular upper and lower contours 110 and 112, which are in conformity with the exterior lines of the upper and lower surface of cover 36 (FIG. 7).

The dual power cylinder assembly 96 (FIG. 3) also includes a pair of oppositely located radially directed bores 114 and 116 which are in registry with the corresponding pair of radial ports 118 and 120 extending from the rifled bore 94 just ahead of the barrel chamber 50 to provide a means for communicating the high pressure gases generated by firing of the cartridge 54 to a pair of piston and cylinder assemblies 122 and 124. Each piston and cylinder assembly 122 and 124 is located with opposite locations on either side of the center line of the barrel 24 so as to be vertically spaced when the automatic weapon 10 is held. This vertical spacing is in general conformity with the shape of the housing 12, the width of the automatic weapon 10 thus being in keeping with easy gripping of the same during firing.

The upper piston cylinder assembly 122 (FIG. 7) includes an upper cylinder tube 126 having a bore 130 while the lower cylinder tube 128 includes a bore 132.

Slidably disposed in the upper cylinder tube 126 and bore 130 is a piston (FIG. 3) comprised of a front piston section 136 integral with a locating stem 138 and an intermediate skirt portion 140. The lower portion and cylinder assembly 124 include a piston which has a front piston portion 142 slidably disposed in the bore 132, integral with the locating stem 146 and an intermediate skirt portion 148. Each of the locating stems 138 and 146 are received within bores 156 and 158 (FIG. 18) formed in a carriage member 150 (FIG. 18) upon which thereby acts the force generated by the gas pressure acting on the front face of the front piston portions 136 and 142. The skirt portions 140 and 148 are of greater diameter than the front piston portions 136 and 142 and the locating stems 138 and 146 of the pistons, and they thus act on the forward face of the carriage 150 to provide a stop during forward travel of the pistons, under the influence of a pair of carriage return springs 152 and 154 and during rearward stroking of the pistons acting to transfer the force applied to the pistons into the carriage member 150.

The symmetrical arrangement of the power cylinders 122 and 124 minimizes the distortion imposed on the various moving components since the forces generated are thereby balanced in the sense that they impose no distorting bending forces on the components. In addition, the stress levels are reduced since the forces necessary are of course carried by two separate piston and cylinder assemblies and are received in oppositely spaced locations on the carriage member 150.

Due to the complexity of the various components involved, the description of various portions of the mechanisms will be carried out in functionally related groupings, these functions being Bolt Actuation, Bolt Locking and Unlocking, Trigger and Selector, and Ammunition Feed. These groupings being along functional lines, certain individual components are common to more than one of the various groupings, but considering each of these separately aids in arriving at an understanding of the complete operation and design of the weapon according to the present invention.

BOLT ACTUATION

Figures 10, 11, 12, 13, 14, 15, 16, 17A:
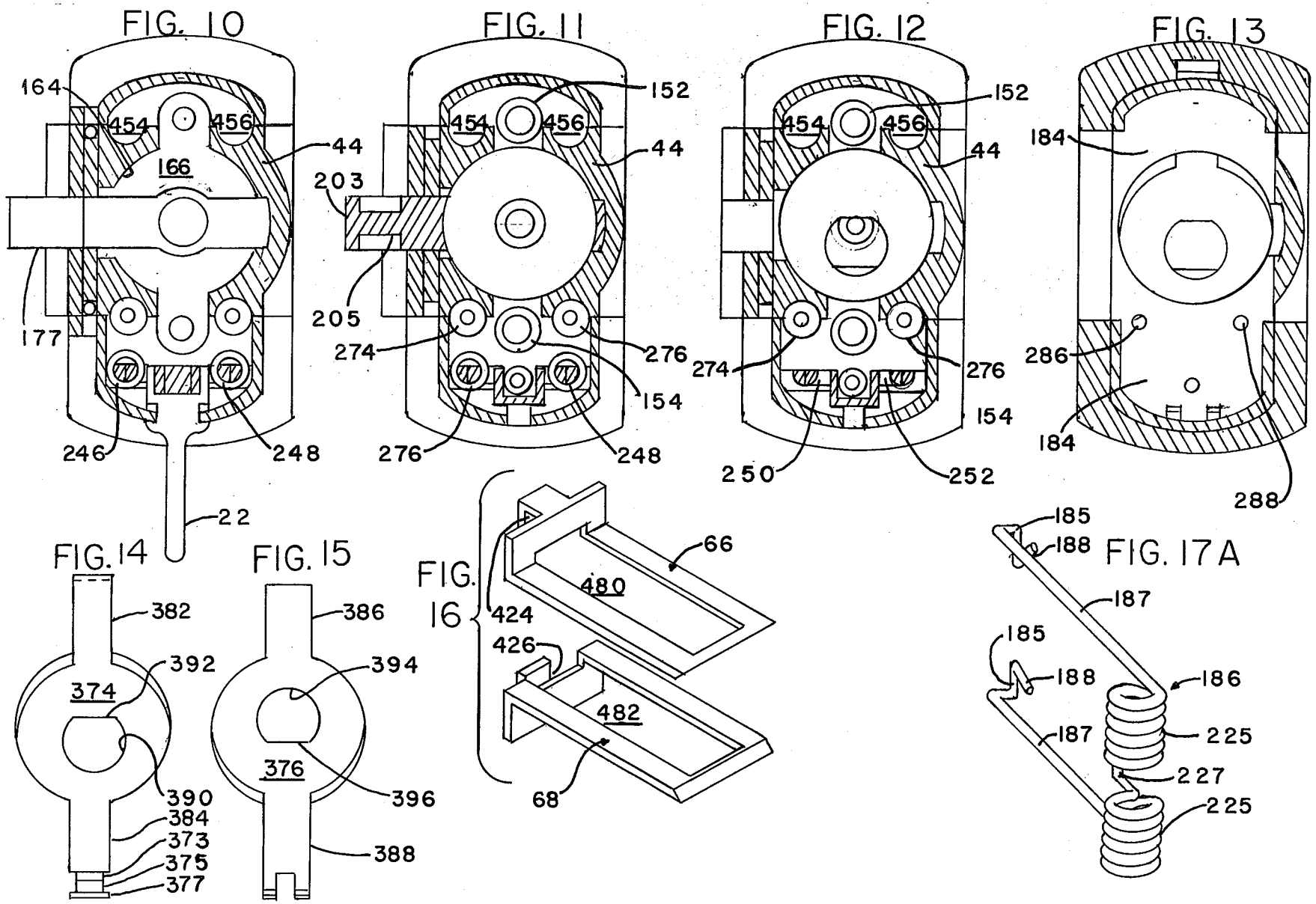
FIG. 10 is a view of the section 10—10 taken as indicated in FIG. 3.
FIG. 11 is a view of the section 11—11 taken as indicated in FIG. 3.
FIG. 12 is a view of the section 12—12 taken as indicated in FIG. 3.
FIG. 13 is a view of the section 13—13 taken as indicated in FIG. 3.
FIGS. 14 and 15 are frontal views of the sliding sear plate mechanism incorporated in the automatic weapon showing alternate operating positions of the sliding sear plates.
FIG. 16 is a perspective view of the upper and lower feed trays utilized to advance the interlinked ammunition belt into the breech.
FIG. 17A is a perspective view of the wound spring latch feed mechanism of the automatic weapon according to the present invention.
Figure 18:
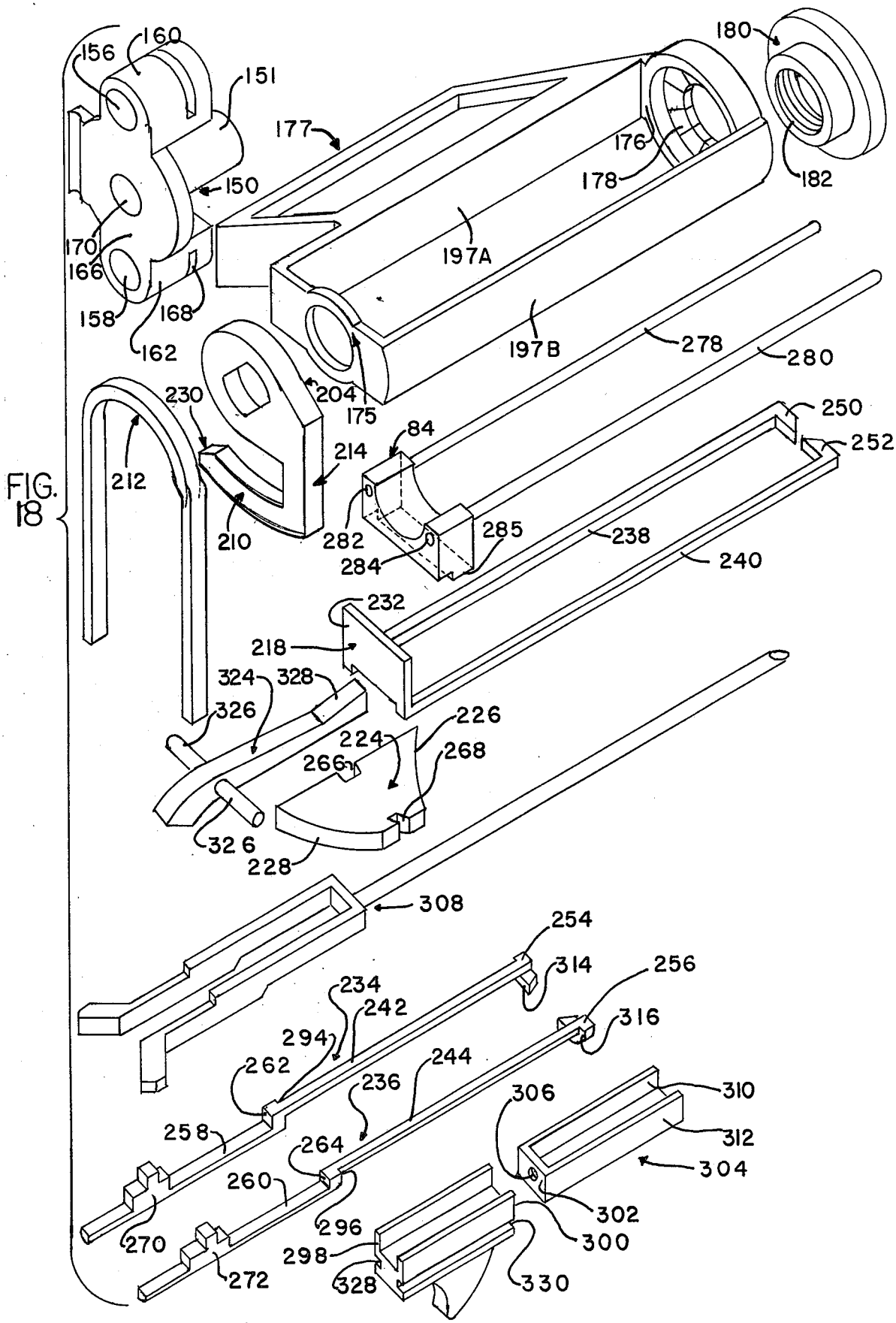
FIG. 18 is an exploded perspective view of the various operating components associated with the operation of the bolt locking and unlocking.

In bolt actuation, the bolt assembly 56 is moved to the rear to extract a fired cartridge casing from the barrel chamber 50, allowing the ejection of the spent casing from the breech, and the introduction of a fresh round into the breech. Finally, the bolt assembly 56 is moved forward to ram the fresh round into the barrel chamber 50. This movement is carried out by means which includes the carriage 150 and, as described above, the carriage 150 is adapted to be driven towards the rear by the power cylinder assemblies 122 and 124, by virtue of the locating stem 138 and 146 of each of the pistons being slidably received in bores 156 and 158 formed in carriage ear portions 160 and 162, as best seen in FIG. 18. The carriage 150 is slidably disposed within the receiver frame 44, the receiver frame 44 being provided with an interior opening 164 which is adapted to receive the sliding carriage as seen in FIG. 10. The carriage 150 is also formed with a central annular plate section 166 which has a central bore 170 (FIG. 18) through which is adapted to be passed the rear bolt extension portion 90. A carriage guide tube 151 is secured to the rear face of the carriage 150 and extends rearwardly a short distance, slidably mounted on the rear extension portion 90 of the bolt assembly 56 to prevent canting of the carriage 150 during relative sliding movements thereof.

The bolt assembly 56 has a forward section 172 (FIG. 8) which has a cross-sectional shape in which a pair of flat surfaces 171 and 173 are machined on the sides thereof which prevent the bolt from rotating in the bolt sliding track 58 formed in the receiver frame 44.

The central bore 170 in the carriage 150 is of a size so as to receive bolt rear extension portion 90 and, together with a front guide ring 175 formed on a feed slider 177, provides an abutment as shown in FIG. 3 for the shoulder formed between the bolt rear extension portion 90 and the forward bolt section 172 so as to provide a driving engagement between the sliding carriage 150 and the bolt assembly 56 during ramming or forward movement of the bolt as will be described.

A central portion annular end plate 166 of the carriage 150 also acts against a flat longitudinal section bolt extraction spring 174 which is disposed concentrically about the rear bolt extension 90 and the carriage guide tube 151 and engages at its rear end the rear guide ring 176 formed on the feed slider 177, which in turn engages an annular high energy Belleville spring 178, abutting a threaded end plate 180 secured to the end of the bolt rear extension portion 90. This is accomplished by means of a threaded stem 182 being threadably engaged with a threaded portion of the rear bolt extension. End plate 180 acts as a reaction point allowing compression of the bolt extraction spring 174 upon rearward movement of the carriage 150 by the power cylinders 122 and 124. The compression of bolt extraction spring 174 is designed to proceed to its fully collapsed condition. This allows it to act as a solid member, transmitting the force applied from the carriage 150 into the high energy Belleville or washer spring 178, by the rear guide ring 176, forcing the same against the end plate 180. The end plate 180 of course during this portion of the cycle is held stationary by virtue of the bolt assembly 56 being locked as will be described hereinafter.

The carriage return springs 152 and 154, on the other hand, are abutted against an abutment plate 184 (FIG. 13) positioned at the rear end of the housing 12 which also serves to absorb the reaction to prevent the pressure of the carriage return springs 152 and 154 from being exerted on the sliding plate sear mechanism 92.

Thus, the bolt extraction spring 174 is designed so that it may be collapsed to its fully compressed length at force levels below those developed by the gas pressure for the purpose of transmitting the pressure exerted by the carriage 150 into the Belleville spring 178, which stores this energy for the purpose of momentarily reducing or eliminating the load exerted on the end plate 180 by compression of the bolt extraction spring 174.

Received within a recess on one side of the receiver frame 44, i.e., the left side as viewed in FIGS. 6 through 13, is a pair of inwardly extending end sections 185 of a wound spring 186 (FIGS. 17A and 17B) which serve in the sequencing of movements during bolt actuation. These normally protrude into the path of a catch tab 189 formed on the carriage 150, but allow it to pass between by virtue of the forward diverging tips 188 and the outward flexing of rearwardly extending intermediate sections 187. The end sections 185 seat within the dished forward face of the catch tab 189 (FIG. 17B) to prevent forward movement upon the abatement of the gas pressure. The tips 188 seat against the forward side of the recess within which they are seated, such that the force acting on the carriage 150 is transmitted into the receiver 44 rather than the intermediate sections 187 themselves.

The carriage catch 189 also functions to restrain the movement of the tips 188 and end sections 185 outwardly whenever the carriage 150 is in forceful engagement therewith due to the frictional forces that are developed therebetween.

Figure 17B:
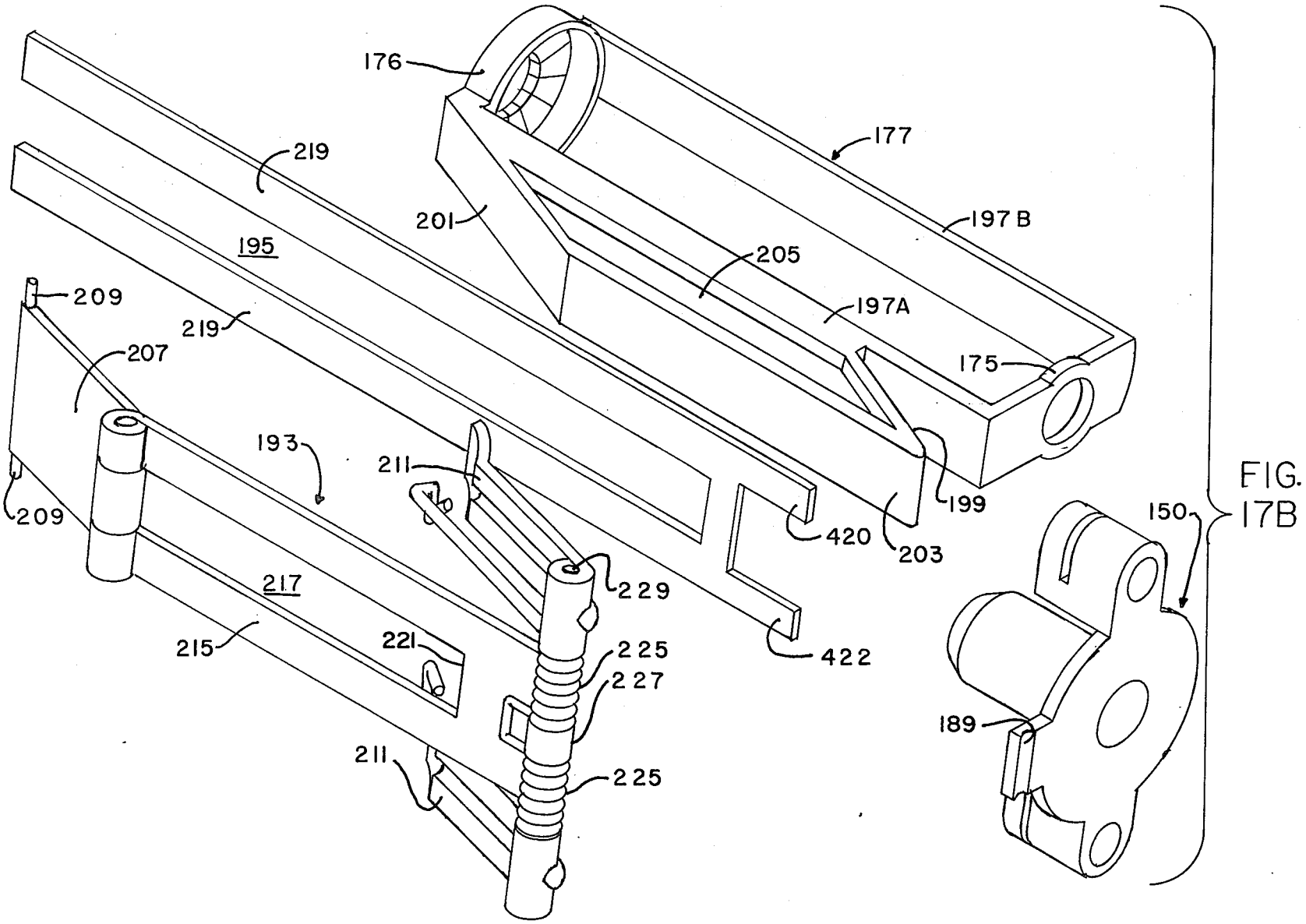
FIG. 17B is a perspective exploded view of the carriage, wound spring latch, feed slider, parallel linkage and feed tray operator fork.

The energy stored in the highly compressed Belleville spring 178 is utilized to unload the end plate 180 from the pressure of the fully compressed bolt extraction spring 174 after the pressure has dropped in the barrel bore 94, this occurring after the bullet has passed out of the bore 94. The reduction in pressure results in a substantially reduced rearward force exerted by the piston assembly 122 and 124 on the carriage 150 which allows the Belleville spring 178 to relax which momentarily reduces the load on the end plate 180. The duration of this reduction in load is extended by the inertia of the feed slider 177 which is accelerated by the force of the compressed Belleville spring 178. The bulk of the feed slider 177, as can be seen in FIG. 17B, is very much greater than the small annular weight employed for this purpose in the above-referenced pending patent application Ser. No. 874,114 and accordingly can be constructed of steel and still provides the necessary means for proper duration of this unload or "hesitator" effect.

It should be noted that an axial clearance would be allowed between the carriage catch tab 189 and the end sections 185 upon full compression of the bolt extraction spring 174, so as to accommodate a slight forward movement of the carriage 150 upon the gas pressure being vented, the carriage 150 then moving into engagement with the end sections 185. This accommodates the movement of the Belleville spring 178 and the annular feed slider 177 as the Belleville spring 178 relaxes.

As noted, the carriage 150 moves slightly forward to engage the end sections 185 and at the same moment, the reduction in rearward pressure allows bolt unlocking to release the bolt assembly 56 as will be described hereinafter.

This release of the bolt assembly 56 allows the compressed bolt extraction spring 174 to force the end plate 180, the attached bolt rear extension 90, forward bolt section 172 and feed slider 177 to the rear, with the carriage catch tab 189 providing a reaction point such that the carriage 150 is rendered stationary against forward movement to force the bolt assembly 56 to move rearwardly and extract the expended cartridge casing from the chamber 50.

During this movement, the frictional interengagement between the end sections 185 and the carriage catch tab 189 prevents outward movement of the end sections 185, which are being urged outward by the wind-up of the wound spring 186 occurring as a result of the action of the feed slider 177 moving to the rear. This condition persists until the bolt assembly 56 moves sufficiently to the rear that the feed slider front guide ring 175 carried with the bolt impacts the front face of the central annular plate 166 of the carriage 150. The momentum of the bolt 56 is such that after rearward travel of the bolt assembly 56, the carriage catch tab 189 is lifted from engagement with the end sections 185, which interrupt the frictional connection therebetween and allows the flexed intermediate sections 187 to move the end sections 185 outwardly, releasing the carriage 150 and allowing it to again move forward under the influence of the carriage return springs 152 and 154.

The movement of the feed trays 66 and 68 through the breech opening takes place by movement of the wound spring 186 after release, as will be described in detail in reference to the feed mechanism.

The forward movement of the carriage 150 also causes the ramming movement of the bolt assembly 56 forward by virtue of the shoulder engagement therewith. The central annular plate 166 of the carriage member 150 moves into abutment with the end surface of the receiver frame 44 as shown in FIG. 3.

The hammer 76 is restrained during forward movement of the bolt assembly by virtue of a stem 198 integral with the hammer head 74 and a sear catch 200, restraining the hammer 76 by engagement with the sear plates 92, as will be described hereinafter. Bolt assembly 56 (and end plate 180) moving forward thus cause compression of the hammer spring 202 during the ramming movement of the bolt assembly 56.

The feed mechanism has in the meantime, prior to the ramming or forward movement of the bolt 56, positioned a fresh round behind the breech in alignment with the bolt assembly 56 and received within grooves 60 thereof (FIG. 7) as will be described.

BOLT LOCKING AND UNLOCKING

As was described in the above-referenced patents to the present inventor, the functioning of the weapon according to this application and those patents does not involve rotation of the bolt and sections thereof to perform the bolt locking function. The bolt locking of course being that function which restrains the bolt from rearward movement during the actual firing of the round, resisting the heavy reaction force tending to drive the bolt to the rear. Rather, the approach described in those patents is to use a non-rotating bolt and a separate locking element which cooperates with recesses on the length of the forward bolt section 172 (FIG. 9) to provide the locking of the bolt assembly 56.

Figure 28:
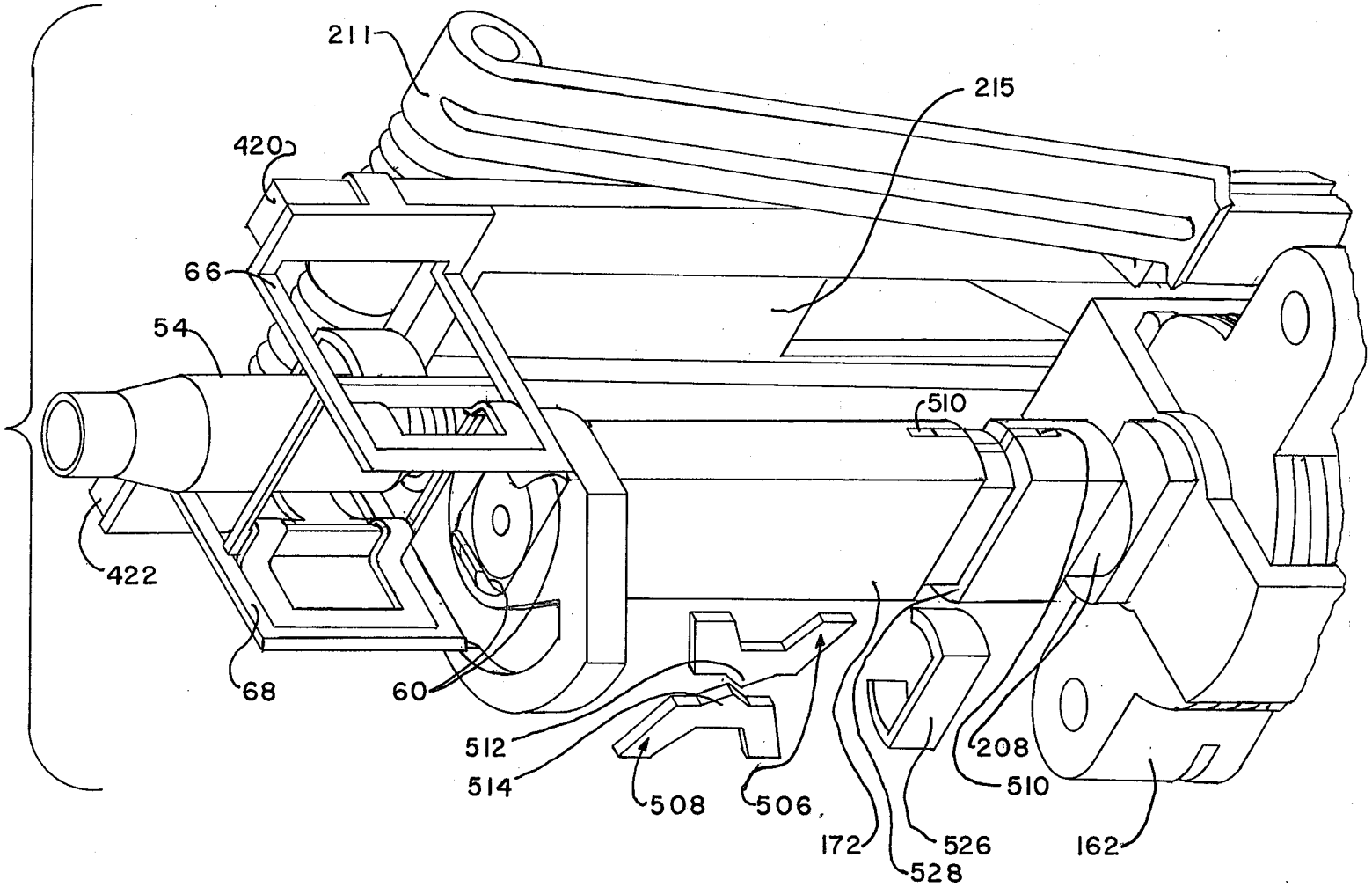
FIG. 28 is a fragmentary perspective view of the weapon components engaging the feed trays during feeding of the ammunition belt through the receiver, as well as an exploded view of certain components associated with the bolt locking mechanism.

Accordingly, a bolt latch element 204 is provided which is received within a recess 206 (FIG. 9) in the receiver frame 44 cooperating with a recess 208 around the main bolt portion 172 (FIG. 28). The bolt latch element 204 has a central opening (FIGS. 18 through 22) which is shaped to be complementary to the cross-sectional configuration of the forward bolt portion 172 such that when the bolt latch 204 is oscillated to the position with the central opening in alignment therewith, the bolt assembly 56 may be released for its rearward extraction movement as described. However, when the bolt latch element 204 is oscillated to a position in which the central opening is out of alignment with the bolt forward sections 172 as shown in FIGS. 7 through 9, the bolt is locked against movement and it can be seen that the rearward forces are resisted by pressure exerted on the front and rear faces of the bolt latch element 204 disposed within the receiver recess 206 and the bolt recess 208.

It is the frictional forces existing between the forward surface of the bolt recess 208 and the rearward surface of receiver recess 206 which are greatly reduced by the arrangement described above in connection with the Belleville spring 178 and the feed slider 177.

The bolt latch element 204 is operated by means of a tail section 210 which is engaged by a U-shaped return spring 212 inversely mounted in a recess in the receiver frame 44 and having a leaf portion lying along side the receiver frame 44 as shown in FIG. 9. The bolt latch return spring 212 is relaxed in the position shown in FIG. 9 such that it urges the bolt latch 204 into a locking position as shown in FIG. 9 with a flat 214 of the actuating tail section 210 lying along the interior edge of the return spring 212 in the latching position shown in that FIGURE.

The tail section 210 is adapted to be received within an arcuate recess 216 formed under receiver frame 44 as shown in FIG. 9. The interior surface opposite the flat 214 abut a flat formed on the receiver frame 44 so as to locate the bolt latch element 204 in the final latching position as shown in FIG. 9.

The bolt latch element 204 is unlatched by engagement with a cam plate 224 (FIG. 18) having a curved configuration in conformance with the arcuate top and bottom radii of the receiver frame 44.

The cam plate 224 has a pair of cam surfaces 226 and 228 formed thereon, cam surface 226 being adapted to engage the end face 230 of the bolt latch element 204 on the extreme end of the arcuate tail section 210. The cam surface 228 would engage this surface upon reversal of the cam plate 224 in the assembly for purposes of left hand operation.

The engagement of the cam plate 224 causes the oscillating movement of the bolt latch element 204 against the bias of the return spring 212 when the cam plate 224 is moved rearwardly.

This rearward movement is brought about in two basically different ways depending on the mode in which the mechanism is being actuated. In the automatic or semi-automatic cycling of the bolt actuation, the cam plate 224 is drawn to the rear by a spring connection with carriage 150, whereas in the manual actuation mode a driving connection is created between the manual actuation slider 22 and the cam plate 224, so as to allow a different sequencing of operation. In the gas pressure operated cycling of the weapon, the unlatching of the bolt assembly 56 necessarily awaits the movement of the carriage 150 to the rear whereas in the manual actuation the bolt must be first released to allow subsequent movement of the parts by simple stroking of the manual actuation slider 22. In addition, the proper sequencing of the parts is produced by the gas pressure preventing operation of the bolt latch element 204 until the bullet has left the barrel. Accordingly, there is a different movement of parts which takes place causing the cam plate 224 to be drawn to the rear in these two basically different modes of operation of the bolt unlocking mechanism.

In the semi-automatic and automatic modes, the carriage 150 is adapted to move a camming fork 218 (FIG. 18) having a face plate 232 which is received within the lower slot 168 of the carriage 150 so as to be moved rearwardly with movement of the carriage 150 to the rear. The rear surface of the face plate 232 engages a spring block 84. The rearward movement of the camming fork 218 is between a pair of cam rails 234 and 236 with the tines 238 and 240 being positioned inside the lateral interior edges of the rear section 242 and 244 of the respective cam rails 234 and 236.

Wound about the tines 238 and 240 and the rear sections 242 and 244 is a pair of compression springs 246 and 248 (FIGS. 10 and 11). This rearward movement compresses the springs 246 and 248 against the protrusions 254 and 256 on the rear sections 242 and 244 of the cam rail 234 and 236, respectively, creating an urging force on each of the cam rails 234 and 236 which tend to urge these rails to the rear.

The cam plate 224 is carried on forward sections 258 and 260 joined to the cam rails 234 and 236 by offset shoulders 262 and 264.

The cam plate 224 has post recesses 266 and 268 which seat on post sections 270 and 272 formed on the forward sections 258 and 260 of the cam rails 234 and 236. By virtue of this connection, there is created an urging force tending to move the cam plate 224 to the rear whenever the unlatching of the bolt latch 204 is prevented by virtue of the pressure exerted on the bolt latch element 204 during firing and while the bullet is still within the bore 94. Upon momentary relaxing of the pressure, by virtue of the Belleville spring the compression springs 246 and 248 are allowed to extend, driving the cam rails 234 and 236 to the rear and carrying the cam plate 224 with it, which by engagement with end face 230 of the bolt latch element 204 unlocks the bolt assembly 56 and allows its rearward or extracting movement as described above.

Spring block 84 compresses by its rearward movement a pair of cam closing springs 274 and 276 (FIG. 11) piloted on rods 278 and 280 as shown in FIG. 18. The cam closing springs 274 and 276 are seated against the butt plate 184 with the pilot rods 278 and 280 secured in bores 282 and 284 of the spring block 84 (FIG. 18) and in bores 286 and 288 of the butt plate 184 (FIG. 13). The outer lugs 285 of the spring block 84 comes into abutment with the shoulders 294 and 296 created by the offset sections 262 and 264 of the cam rails 234 and 236. Thus, the springs 274 and 276 being compressed create a return force on the cam rails 234 and 236.

After the bolt assembly 56 returns to the forward position, the compressed springs 274 and 276 acting on the spring block 84 drive the camming rails 234 and 236 to the forward position carrying the cam plate 224 therewith and allowing the return spring 212 to again position the bolt latch element 204 in the latched position.

The manual actuation slider 22 is formed with a pair of integral rails 298 and 300 which are adapted to be disposed between the interior lateral faces of the tines 238 and 240 of the camming fork 218. The rear surface of the rails 298 and 300 are in abutment with the front face 302 of a manual operation tray 304. The manual operation tray 304 is likewise slidably disposed between the interior surfaces of the fork tines 238 and 240 allowing a clearance for the springs 246 and 248. The manual operation tray 304 is also formed with a trigger fork opening 306 which is adapted to receive the trigger fork 308 which will be described in operation in conjunction with the Trigger/Selector.

The manual operation tray 304 is formed with a pair of slide rails 310 and 312 which upon movement of the manual actuation tray 304 to the rear engage the stops 314 and 316 formed on the lower edge of the rear portion of the cam rails 242 and 244 and subsequently the protrusions 250 and 252 formed on the tines 238 and 240 of the camming fork 218.

Upon rearward movement of the manual actuator 22, the slide rails 298 and 300 force the manual actuation tray 302 to the rear which in turn carries the cam rails 234 and 236 to the rear which unlatch the bolt assembly 56 by movement of the cam plate 224 past the end face 230 and then subsequently engages the camming fork 218 moving the bolt assembly 56 to the rear by movement of the carriage 150 acting on the bolt extraction spring 174.

The bolt assembly 56 is adapted to remain in the open position upon retraction to the rear to clear the breech opening by means of a rocker catch 324 which is pivoted by means of a cross support 326 within the rear cover 38. The rocker catch 324 has a rearward portion 328 which is adapted to be rocked up into engagement with the frontal face of the face plate 232 of the camming fork 218 so as to latch the same in the retracted position. The rocker catch 324 can be activated by means of operation of the manual actuation slider 22.

Figure 19:
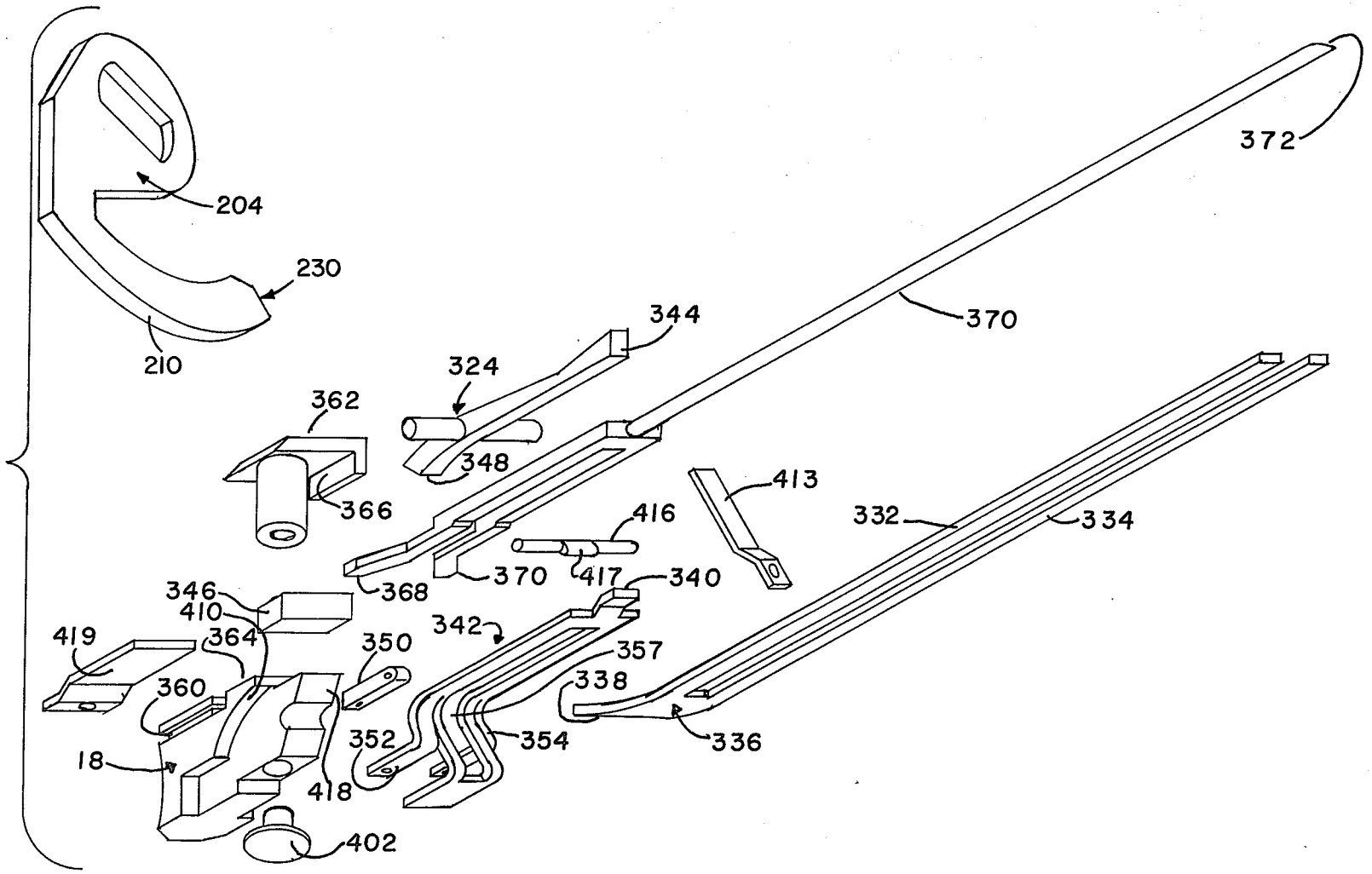
FIG. 19 is an exploded perspective view of various components associated with the trigger selector mechanism incorporated in the automatic weapon according to the present invention.

The manual actuation slider 22 has a pair of side rails 298 and 300 into which are formed recesses 328 and 330, which receive opposite sides of a pair of tines 332 and 334 of a leaf spring 336 (FIG. 19). Rearward movement of the manual actuation slider 22 allows the end 338 of the leaf spring 336 to curl upwardly and into engagement with a tab 340 formed on a selector spring 342. Tab 340 engages the underside 344 of the rocker catch 324 so as to ride up in front of the cam fork 218 as described.

The disengagement of the rocker catch 324 and bolt assembly 56 is caused by the trigger mechanism in which a block member 346 (FIG. 19) engages an inclined front face 348 of the rocker catch 324 forcing it to rotate about pivotal support 326 and out of engagement with the cam fork 218 to thereby release the same.

In the automatic mode, the selector spring 342 is urged upwardly by means of the movement of the selector lever 34 which is engaged with a pair of selector links 350, one of which is shown in FIG. 19 which in turn is connected to a pair of tabs 352 and 354 on a selector spring 342 so as to produce the upward bias of the tab 340 when the selector lever 34 is in its fully rotated position as will be described hereinafter.

THE TRIGGER/SELECTOR MECHANISM

The trigger/selector mechanism components are shown in FIGS. 19 through 22, and include the trigger 18 which is slidably disposed in the housing 12 by receiving the lower edges of the cover 38 which form a slot in which is received the recessed upper portion 360 of trigger 18 so as to provide a slidable mount for the trigger 18.

Trigger 18 is adapted to engage the trigger fork 308 by means of a trigger plate 362 in the semi-automatic mode. The trigger plate 362 is seated on the upper portion 364 of the trigger 18 (FIG. 19) with a lateral surface 366 extending along the edge of the upper surface 364 so that as the trigger is pulled, the trigger plate 362 moves to the rear and engages one or the other of prongs 368 and 370 of the trigger fork 308 depending on whether the weapon is assembly for right or left hand operation.

The trigger fork 308 has a stem portion 370 with a sloping end surface 372 which acts to engage with a sloping surface 373 of sear plate 374 (FIG. 3).

The sliding plate sear mechanism 92 is of the type described in the above-mentioned patents and includes a pair of leaf bias springs, an upper bias spring 378 (FIG. 3) and a lower bias spring 332 and 334 (FIG. 19) comprised of the end sections of a leaf spring 336. The front sear plate 374 and rear sear plate 376 are both mounted by means of a pair of slidable tabs 382 and 384, and 386 and 388, respectively (FIGS. 14 and 15).

The front sear plate 374 has a central opening 390 with an upper flat 392 (FIGS. 14 and 15), while the rear sear plate opening 394 has a lower flat 396. The tab 382 is engaged with the upper leaf spring 378 as is the upper tab 386 of the rear sear plate 376. The upper leaf spring 378 dominates the lower bias springs 332 and 334 such that both sear plates 374 and 376 will be urged to the downward position by the upper sear springs 378 when the trigger fork stem 370 is not forcefully engaging the lower tab 384. When the hammer catch 200 is moved to the rear by movement of the bolt assembly 56 to the rear during bolt extraction movement, the sear catch 200 is moved to the position shown in FIG. 3 and the chamfered surfaces 398 cooperating with similar surfaces on the flats 392 and 396 of the sear plates 374 and 376 to push the same out of the way.

When both sear plates 374 and 376 are retained in the initial depressed condition by virtue of the dominant influence of the spring 378, the sear catch 200 catches on the upper flat 392 of the frontal sear plate 374 moving past the rear sear plate 376 which has been depressed by the dominant spring 378. Upon movement of the trigger fork 308 to the rear, the frontal surface 373 of the sear 374 influenced by the terminal portion of the stem 370 forces front sear plate 374 upwardly to displace the flat 392 and release the sear catch 200 allowing the hammer spring 202 to drive the hammer head 74 forward and fire the weapon by impact with the rear portion of the firing pin 72.

The semi-automatic mode of the firing cycle, of course, would take place sufficiently rapidly that the firer would still have his finger on the trigger 18 and hold it in the depressed condition and the rear sear plate 376 acts to catch the sear catch 200 in this event since the surface 373 influenced by surface 372 has forced the front sear plate 374 upwardly, removing the influence of the upper leaf spring 378 on the rear sear plate 376. The front sear plate 374 is formed with a lower tab 375 including a cross piece 377 which is positioned beneath the leaf spring portions and acting to urge the leaf spring portions 332 and 334 upwardly. This causes the lower leaf spring portions 332 and 334 to act on the rear sear plate 376 and force it upwardly into catching position so that the lower flat 396 will now retain the sear catch 200 until the trigger 18 is released. Release of the trigger 18 allows the upper leaf spring 378 to again dominate and the sear catch 200 to slip forward to be caught by the front sear plate 374 then to be released by another depression of the trigger 18.

The selector lever 34 controls the rotation position of the pair of selector links 350 by being connected to a common selector lever pin 416 (FIG. 3) with clearance 414 formed in the trigger 18 to accommodate pin 416 when trigger 18 is depressed.

In the fully automatic mode, the selector lever 34 is rotated so as to cause the links 350 to move the selector spring 342 upwardly with the lower step portion 400 engaging the lower stem 402 of the trigger plate pedestal 404. A compression spring 406 (FIG. 3) is provided which biases the trigger plate 362 downwardly in the semi-automatic mode so that the lateral surface 366 remains in engagement with the trigger 18 as described, but rotation of the selector links 350 downwardly, the step tab 400 overcomes the bias of the compression spring 406 (FIG. 3), forcing the pedestal upwardly and allowing it to become pivotable with respect to the trigger 18.

The trigger plate 362 in this mode is adapted to be oscillated by means of a lower arcuate surface of the bolt latching element 204.

The trigger fork 308 is biased forwardly by means of the manual actuation return spring 412 which, acting on the interior of the manual actuation tray 304 and the opening 306 acting on the shoulders of the trigger fork 308, acts to urge the trigger fork 308 forward. By engagement of either end prong 368 or 370, this bias acts to urge the pedestal 404 to be rotated so that the trigger plate 362 is rotated into the path of the end face 230 of the tail section 210 of the bolt latching element 204.

Figures 20, 21, 22:
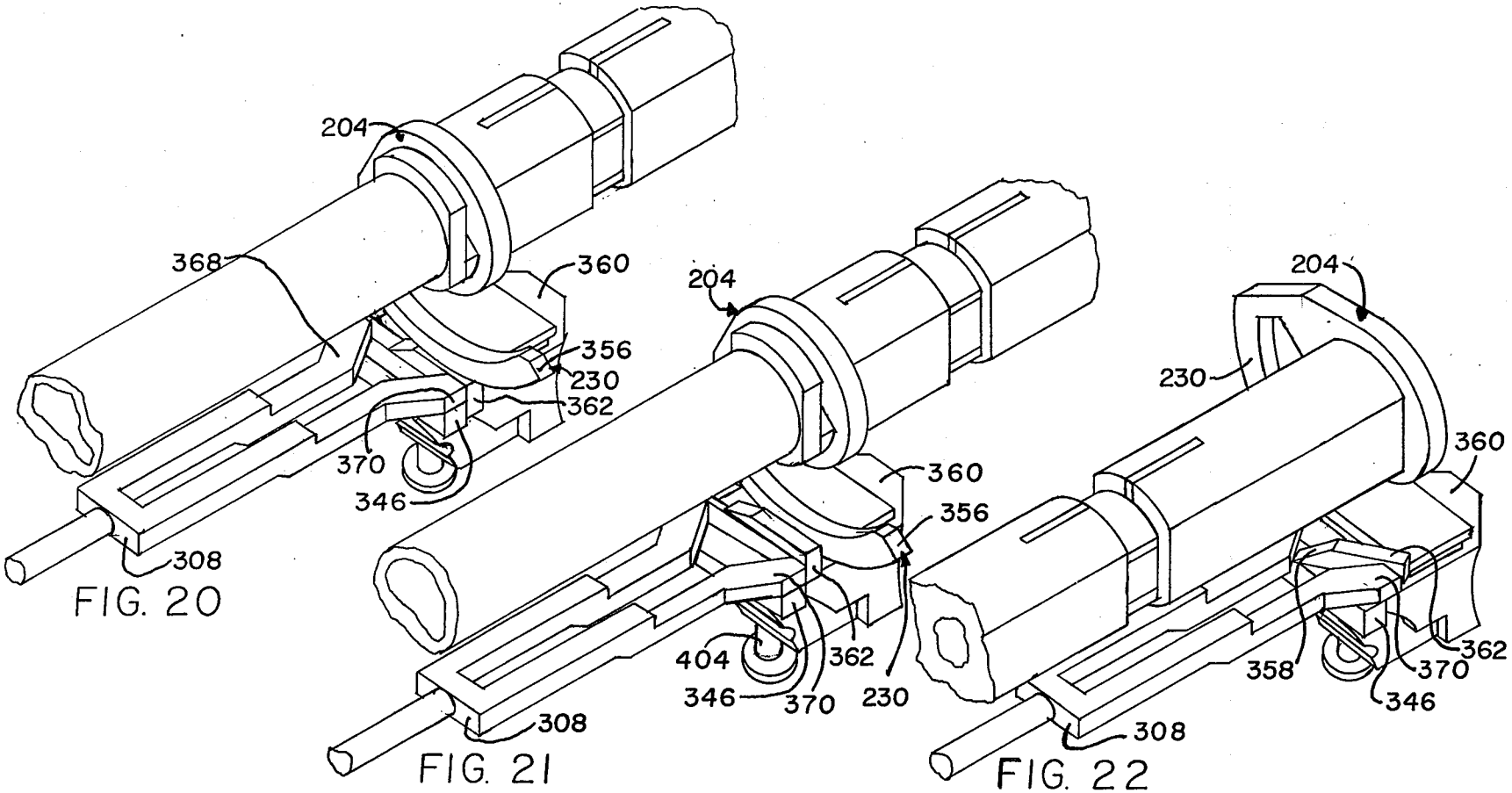
FIGS. 20 through 22 are perspective views of the bolt latching element and the trigger mechanism components operated by the bolt latch, showing in each of the views different relative positions of the bolt latching element and the relative trigger mechanism components occuring during operation of the trigger.

Thus, each time the bolt latching element 204 is moved by the cam plate 224 to the unlatched position, the trigger fork 308 rotates the pedestal trigger plate 362 forward as shown in FIG. 22. Upon movement of the bolt latching element 204 to the latched position, the trigger plate 362 is rotated about its pedestal 404 forcing the trigger fork 308 rearward to the position shown in FIG. 21, to thus fire the weapon automatically when the selector lever 34 is in the automatic position and trigger 18 is depressed.

Cessation of automatic fire upon release of the selector 34 is accomplished by engagement of the surface 356 formed on the end face 230 of the bolt latching element 204 moving into engagement with a ramp surface 358 formed on the side of the trigger plate 362, which has moved into the path of the end face 230 by release of the trigger 18. This cams the trigger plate 362 and pedestal 404 down to the position shown in FIG. 20 to discontinue firing.

An interlock arrangement is provided by interference between the bolt latch tail 210 and the pedestal plate 362 when the automatic mode select is first initiated as shown in FIG. 20. Thus, the pedestal 404 will not be allowed to move upwardly out of engagement with the trigger surface 364 by rotation of the selector lever 34 until the trigger 18 has been depressed to initiate the automatic firing cycle. Depression of the trigger 18 moves the trigger plate 362 rearwardly out of alignment with the bolt latching element tail 210 allowing the pedestal 404 and trigger plate 362 to be moved upwardly to the position shown in FIG. 21. The weapon may then cycle in the normal fashion in the automatic mode. Thus, the automatic mode of operation must be selected before the trigger is depressed.

The trigger return spring 413 (FIG. 19) is disposed behind the trigger 18 and anchored to the lower cover at the top rear of the hand grip, in line with the open slot 357 of the selector spring 342.

The selector lever 34 is also used as a safety with the leading edge of the links 350 (FIG. 19) moved in the safety position to cooperate with a curved recess 410 formed on the trigger 18 to prevent the trigger 18 from being depressed so as to act as a weapon safety.

Upon movement of the selector lever 34 in the counterclockwise direction as viewed in FIG. 3, the tab portion 340 of the element 342 is urged upwardly such that if the weapon is being fired in the automatic mode, the selector lever 34 is manipulated to this position and the trigger 18 is released and block 346 is released from full force engagement with surface 348. The rocker catch 324 is thus again urged into latching engagement with the frontal surface of the camming fork 218 so that the bolt assembly 56 will remain in the full open position, thus providing means for automatically causing the bolt to be latched in its rearmost position upon cessation of fire.

It is necessary to insure that the trigger 18 does not move forwardly to the return position as the bolt assembly 56 is moving forwardly since this could result in the bolt assembly 56 remaining in the closed position. Upon cessation of fire, this is generally undesirable since the last-seated ammunition round 54 could be caused to "cook off" or sieze in the chamber 50.

Accordingly, the selector pin 416 is formed with a cam surface 417 which rotates into engagement with the trigger return spring 413 to disable it when the selector lever 34 is in the fully automatic mode position.

A trigger drag spring 419 (FIGS. 3 and 19) imposes a frictional drag force on the trigger 18 to insure that the trigger 18 does not drift into the return position.

Should the user then desire to close the bolt without firing the weapon, the lever 34 is then rotated clockwise past the safety position. This rotates the pivotal link into contact with block 346 sliding it rearward until it strikes the forward edge of the rocker catch 324 rotating it to disengage from the front face 232 of camming fork 218.

AMMUNITION FEED AND EJECTION

The ammunition feed system includes a pair of feed trays 66 and 68 (FIG. 16), feed slider 177, which were previously mentioned, a parallel linkage 193, and a feed tray operator fork 195 (FIG. 17B).

The parallel linkage 193 is moved in and out with respect to the receiver frame 44 by the reciprocation of the feed slider 177.

The feed slider 177 is formed with inner and outer longitudinal bars **197*a* and 197*b*, joining the front guide ring 175 and the rear guide ring 176. Extending outwardly from the inner longitudinal bar is a front ramp bar 199 and a rear ramp bar 201, joined by an outer longitudinal bar 203. A central stiffening web 205 joins bars 197*a*, 199, 201 and 203**.

The parallel linkage includes a rear strap 207 pivotally mounted by pins 209 to the receiver frame 44, with a pair of forward spaced straps 211 configured at the ends to be received in recesses 213 (FIGS. 1 and 2) in the upper forward cover 36 and in the lower rear cover 38.

Both the rear and forward straps 207 and 211 are pivotally mounted to a slotted connector strap 215. The slot 217, as well as a slot formed by rearwardly extending tines 219 of the feed tray operator fork 195, accommodates the ramp bars 199 and 201, as well as the outer longitudinal bar 203 so that the parallel linkage 193 may be operated by reciprocation.

Figure 27:
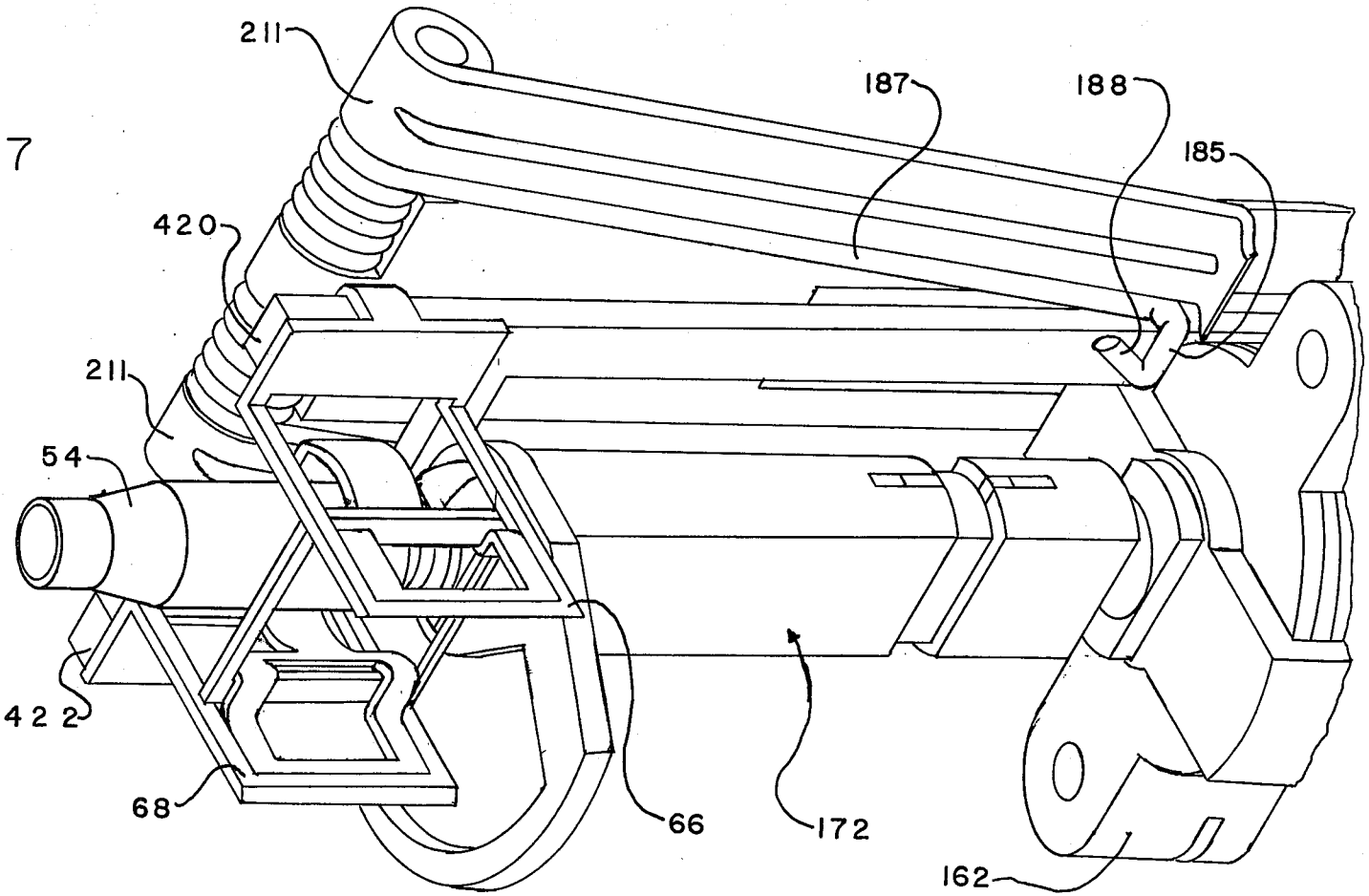
FIG. 27 is a fragmentary perspective view of the components depicted in FIGS. 25 and 26 shown at the moment of carriage unlatch.

As the feed slider 177 moves to the rear, the rear ramp bar 201 forces the parallel linkage 193 outward (FIG. 27). As it moves forwardly, the forward ramp bar 199 engages the leading edge 221 of the slot 217 forcing the parallel linkage 193 back into position against the receiver frame 44.

The feed tray operator fork 195 has a pair of forwardly extending fingers 420 and 422 which pass into respective openings 424 and 426 of the upper and lower feed trays 66 and 68, respectively, such that the feed trays 66 and 68 are moved therewith in and out by movement of the feed tray operator fork 195.

The feed tray operator fork 195 in turn is urged outwardly upon movement to the rear of the feed slider 177 and outward movement of the parallel linkage 193 by the action of the wound spring 186.

The wound spring 186 includes a wound section 225 encircling a pivot pin 229 joining straps 211 to the parallel linkage 193 and a central anchor section 227 resting against the connector strap 215 (FIG. 17B). The wound spring 186 is tensioned by outward movement of the parallel linkage 193 since the end sections 185 are restrained by virtue of their frictional engagement with the dished face of the carriage catch tab 189 at this point in the weapon cycle (FIG. 27).

The end sections 185 pass behind the tines 219 such that the spring tension generated by outward movement of the parallel linkage 193 and resulting wind-up of the wound sections 225 and flexing of the intermediate sections 187 can exert an outward urging force acting on the feed tray operator fork 195.

However, this end section 185 remains frictionally engaged with the dished forward face of the carriage catch tab 189 until released by rearward movement of the bolt assembly 56 as described above.

Upon movement of the bolt assembly 56 completely to the rear, the impact on the carriage 150 and end sections 185 is released causing the wound spring 186 to force the feed tray operator fork 195 outward, thereby moving the feed trays 66 and 68 outwardly by the fingers 420 and 422 during the interval of hesitation before the bolt assembly 56 returns (FIG. 7).

As the bolt assembly 56 rams the next cartridge 54 into the chamber 50, the ram bar 199 cams the edge 221 inwardly, forcing the parallel linkage 193 inwardly into abutment with the receiver frame 44. This causes the feed tray operator fork 195 to move the trays 66 and 68 back to the return position shown in FIGS. 6 through 8.

The feeding movement of the feed trays 66 and 68 causes the spent casing to be stripped from the bolt face 62 by the movement of the link belt and advancement of a fresh round into the grooves 60 in the bolt face 62 (FIG. 28). The forward movement of the bolt assembly 56 secures the link belt in position so that upon lateral movement of the parallel linkage 193 back into abutment with the receiver frame 44, the belt remains stationary while the feed trays 66 and 68 ride over the link and engage the trailing edge of the next link in preparation for another feed cycle in the assembly.

Before describing the engagement of the feed trays 66 and 68 with the link belt, the links 432 and the belt assembly will first be described.

Figure 23:
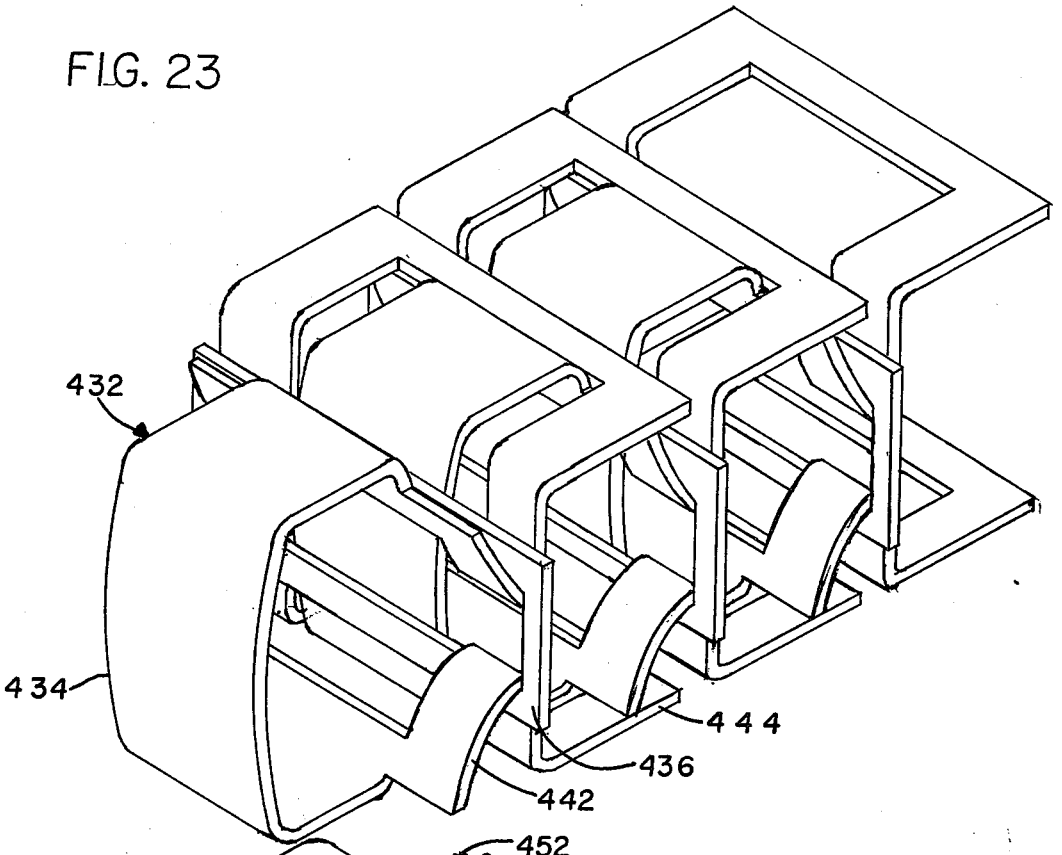
FIGS. 23 and 24 are views from differing perspectives of an assembly of several of the links in the ammunition belt which is adapted to cooperate with the feeding mechanism incorporated in the automatic weapons according to the present invention to feed belt-mounted ammunition automatically into the weapon and to receive extracted cartridge casings and carry them out of the receiver branch opening.
Figure 24:
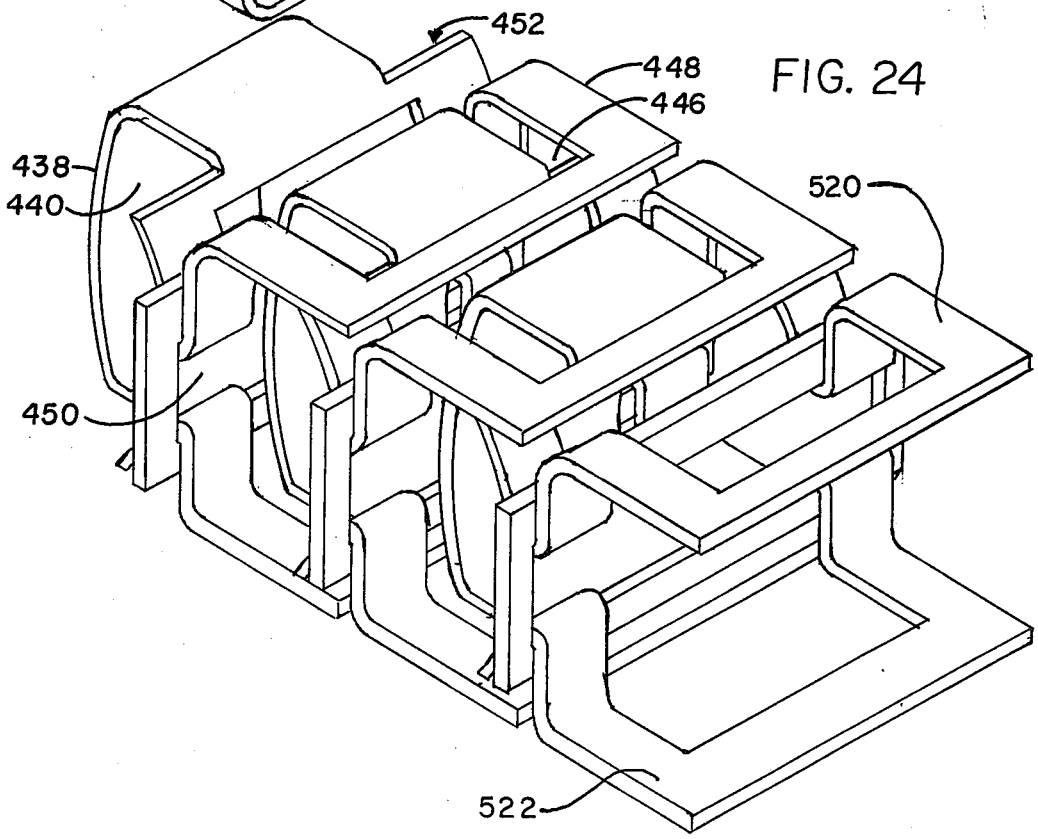

FIGS. 23 and 24 illustrate in two different perspectives an assemblage of links 432 forming a belt for directing ammunition to the feed mechanism. Each link 432 includes a loop element 434 and a cinching element 436. The loop element 434 is formed of spring steel stamping or other suitable construction comprising a forward loop section 438 having an opening 440 of appropriate configuration for the type of ammunition to be used. Also, each loop element 434 has a pair of leg sections extending from the loop section 438 from closely spaced points having outwardly diverging portions 442 and 444, respectively. The leg sections 448 terminate in forwardly bent sections forming shoulders 452 of greater width than the forward loop sections 438 and formed with an opening at 446 so as to receive therein the upper portion and lower portion, respectively, of the loop section 438 of the succeeding link. The leg sections 448 are retained together by means of the cinching element 436 having an appropriately sized opening 450 so as to correctly position leg sections 448 apart so that a frictional engagement may be obtained upon snapping the leg sections 448 over the forward loop sections 438 as shown in FIGS. 23 and 24.

To assemble each link, each individual link is joined with a cinch element 436 passed over the leg portions 448. This may require forming of the leg sections 448 after the cinch element 436 has been placed in position or the cinch element 436 may be formed with a reasonable seam so as to enable the assembly to be carried out.

It can be seen that the link belt assembly shown in FIGS. 23 and 24 with the limited relative rotation accommodated by the shoulders 452 and engagement with the successive link maintains the belt assemblage in a more or less horizontal mode such that as the belt is fed into the breech opening 40, excessive downward curvature such as to create a misfeeding of the link belt due to the openings 480 and 482 (FIG. 16) not properly engaging the surfaces 448 is precluded.

As noted, the lateral movement of the upper and lower feed trays 66 and 68 causes the ammunition belt to be advanced into the receiver frame breech opening 40.

A pair of oppositely extending tabs 502 and 504 (FIG. 8) are provided mounted on either side of the breech opening which serve to exert an inward resilient biasing pressure on feed trays 66 and 68 as the feed trays 66 and 68 are moved through the receiver opening to insure grasping pressure of the feed trays 66 and 68 in engaging the links 432 in the link belt assembly.

The engagement of the feed trays 66 and 68 is by nesting of the leg portions 448 in each link 432 on either side of each link 432 into respective recesses 480 and 482. The pressure exerted by the tabs 502 and 504 thus insures the recesses properly engaging the legs 448.

Figure 25:
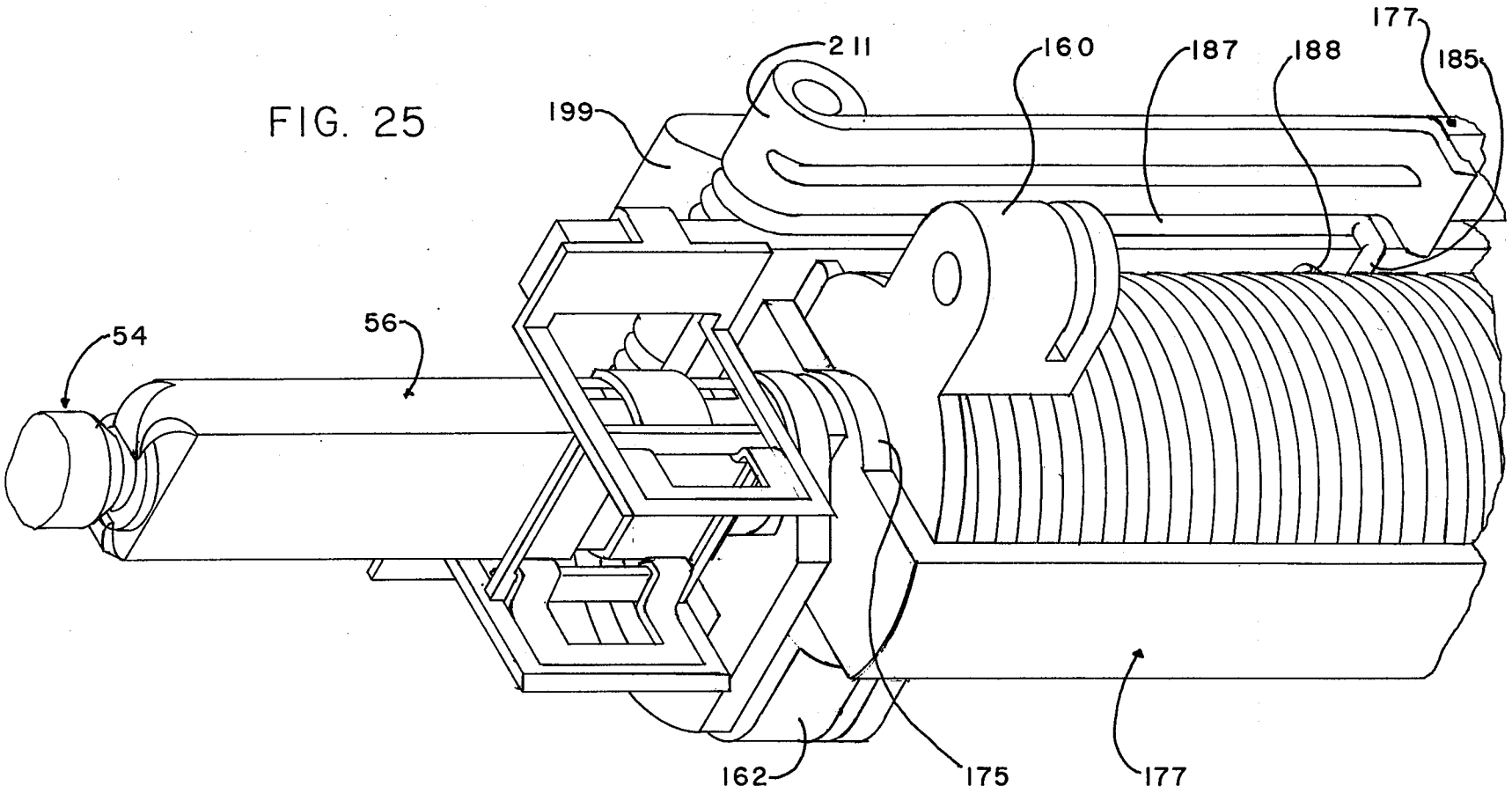
FIG. 25 is a perspective fragmentary view of weapon components associated with the weapon feed mechanism shown in their position at the moment of firing.
Figure 26:
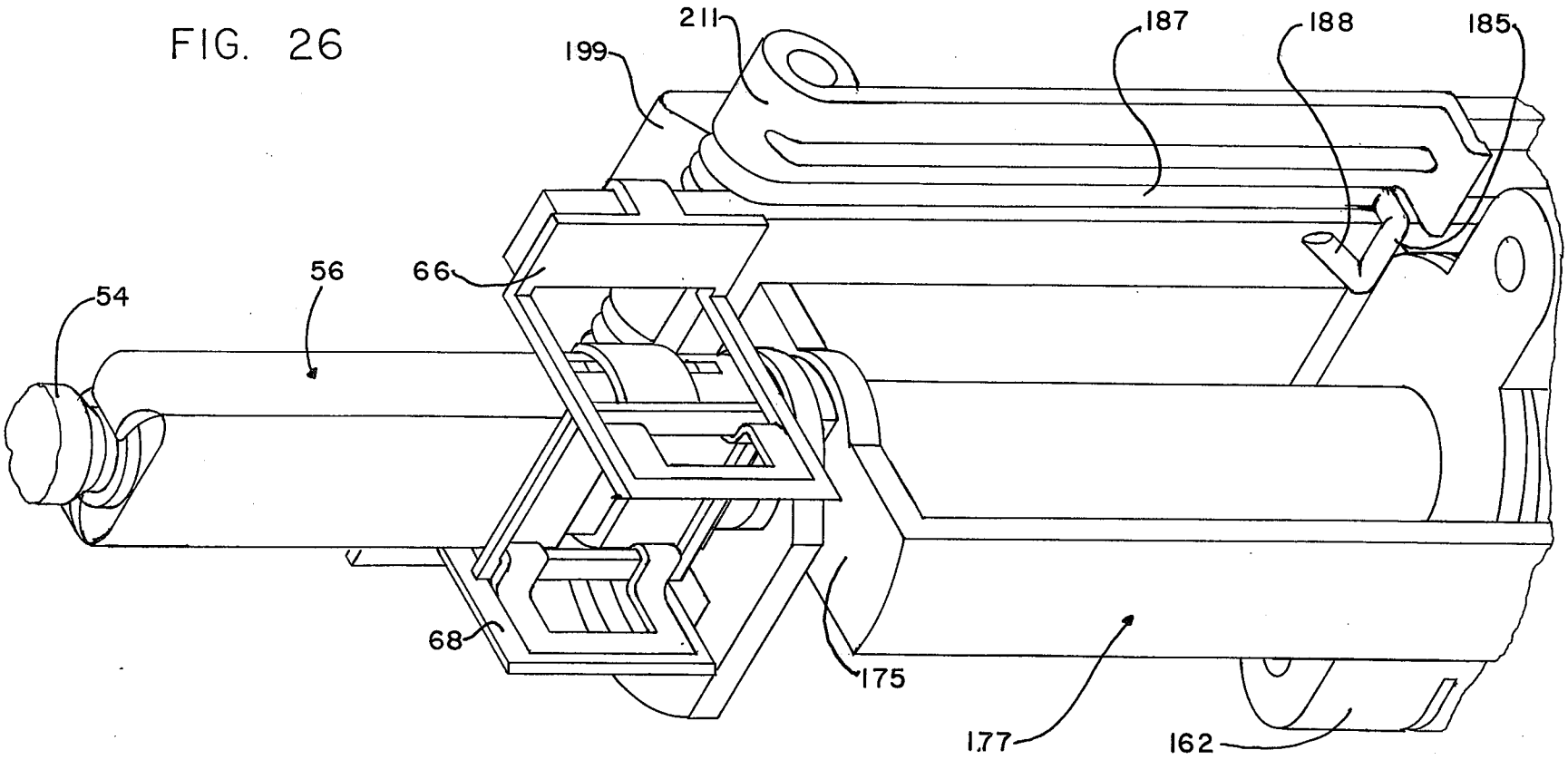
FIG. 26 is a fragmentary perspective view of certain of the components depicted in FIG. 25, in their position immediately after firing, with the carriage moved to the latched position.

The outer portions of the ends of the feed trays 66 and 68 are oppositely chamfered as seen in FIGS. 25 and 26 to allow the feed trays 66 and 68 to ride up over the leg portion 448 of each link 432 which remains stationary in the breech opening 40 when the bolt assembly 56 is in the advanced position as shown in FIG. 25, and during the inward movement of these feed trays such as to move out of engagement with the link loop section previously centered within the breech opening 40 and which will be separated from the link belt as will be described.

In the position shown in FIG. 25, the inward movement of the feed tray operator fork 195 has taken place and leg section 448 of link 432 has just been received within recesses 480 and 482.

As can be appreciated from the description above, the links 432 in the link belt assembly are assembled together without the shell casing 50 holding the assemblage of the respective links 432 together as in conventional automatic weapon ammunition belts. Thus, unless the links 432 are separated after being advanced beyond the bolt, the belt containing shell casings would grow in length and perhaps present difficulties in handling of the weapon if a considerable length of belt accumulates.

Accordingly, means are provided for separating the links from the belt after the respective link has positioned its round beyond the bolt, but still within the weapon receiver opening 40. This arrangement includes a pair of spreader wings 506 and 508 as shown in FIGS. 28, 3 and 8, each received within longitudinally extending slots 510 formed within the bolt main portion 172 as seen in FIG. 28. Each spreader wing 506 and 508 is formed with a central wedge 512 and 514 which is adapted to mate with a mating wedge-shaped recess 516 and 518 (FIG. 3) formed on either upper or lower surface of the firing pin 72 when in the cocked position. The shape of the wings 506 and 508 is produced by opposite separated end portions 520 and 522, respectively, which serve to straddle the link loop sections 438 when the link loop element 434 is positioned in surrounding relationship with the bolt main portion 172.

The separation occurs upon firing which causes the wedges 512 and 514 to be forced out of the corresponding recesses 516 and 518 formed in the firing pin 72. The end portions 520 and 522 straddle the link loop portions 438 and come into engagement with the inside surface of the link leg 448 of the link previously advanced beyond the bolt and remains engaged with the succeeding link by being frictionally overlying on the loop portion 438 of the link 432 remaining centered on the bolt main portion 172.

The movement of wing separators 506 and 508 is against the bias of the spring clip 526 which encircles main bolt portion 172 and is disposed within a recess 528 formed about the central region of longitudinal slot 510 in order to be accommodated by the slide-through opening of the bolt latch 204. The spring clip thus insures return movement of the wing portion 506 and 508 back into engagement with the firing pin after the firing pin has been struck by the hammer.

Thus, upon spreading of legs 448 by the outward movement of end portions 520 and 522, a separation force is generated by the compression together of legs 448 and reflected in a force component acting to cause the link to move away and outwardly of the extending wing end portions 520 and 522 causing the links to be completely separated from the remainder of the belt assembly. This occurs at the moment of firing.

This arrangement also enables the looping of a length of ammunition belt to shorten the trailing length of the belt. That is, if the length of the belt carried by the firer is substantial, the movements of the firer would be somewhat impeded by the length of the trailing portion of the belt. Since the arrangement described produced automatic separation of each link from the belt after firing, the trailing end of the belt may be secured in engagement with the link loop encircling the bolt or protruding from the receiver if the weapon has just been fired to create a closed loop of the belt, substantially shortening the trailing length of the belt and greatly improving the mobility of the firer.

Upon firing of the first round, the link is separated to release the end of the belt for normal feed operation.

As shown in FIG. 8, the end portions of the feed trays 66 and 68 are protected by a pair of blocks 524 and 526 which serve to prevent damage to the relatively fragile feed tray ends 66 and 68 as they are projecting from the receiver opening during the feed movement capturing the next link leg 448.

In FIGS. 25 through 28, the succeeding link is not shown in order that the details can be seen of the engagement of the link 432 being advanced out of the receiver.

To recapitulate the feed sequence, in FIG. 28 the bolt assembly 56 has moved to the rear allowing the feed tray operator fork 195 to be moved away from the receiver frame 44, and move the feed trays 66 and 68 away as viewed in this FIGURE, causing the link 432 to be moved out of alignment with the bolt main portion 172.

However, in the position shown in FIG. 28, if there were a succeeding link, its loop section 438 would have been drawn into alignment with the bolt main portion 172 in this position, by engagement of the feed trays recesses 480 and 482 pulling the link 432 with movement of the feed trays 66 and 68. Thus, upon advancing movement of the bolt main portion 172 during the return of the bolt assembly, the bolt main portion 172 passes through this loop section 438 such as to anchor the same in position within the receiver opening 40.

Accordingly, upon the feed tray operator fork 195 being again returned against the receiver housing 44, the feed trays 66 and 68 may then move relative to the link which it had previously been engaged with.

The leading chamfered surfaces guide the motion of the feed trays 66 and 68 over the next leg portion 448 of the link which has its loop section 438 centered on the bolt main portion 172 (FIG. 25) to secure engagement therewith preparatory to the next feeding motion.

When the round is discharged, the separator wings 506 and 508 move outwardly from each other to spread the leg portions 448 of the links which have been advanced beyond the bolt to separate the link from the link belt assembly.

It can be appreciated that the use of the relatively massive feed slider 177 provides sufficient bulk while providing sufficient mass to allow the momentary unloading of the bolt locking mechanism sufficient for the unlocking cycle to take place before reexertion of the bolt extraction spring force.

In addition, the activity of the feed slider 177 in cooperation with the parallel linkage 193 provides a more positive operation of the feed mechanism since the development of the urging force exerted by the feed tray operator fingers 420 and 422 positioned much closer to the feed trays does not rely on the simple flexing of the leaf spring described in the above-cited copending patent application.

In addition, it should also be noted that the configuration of the feed trays has been simplified by the incorporation of the spring tabs 502 and 504 enabling the squeezing bias pressure to be applied to the feed trays only at the moment whereat they are to grasp the succeeding links and thus it may be seen that the above-cited objects of the present invention are achieved by the present design.

Also, the simple but rugged construction of the feed mechanism is in keeping with good design practice for military weaponry.

The spring force exerted on the feed tray operator fork 195 is properly related in time to the feed sequence, such that it is only exerted at the moment of feed. This is by virtue of the sequencing achieved by release of the end sections 185 after the bolt assembly 56 has reached its rearmost position and impacted the carriage 150.

I claim:

1. A gas operated automatic weapon comprising:

a receiver frame;

a barrel having a bore and chamber formed therein and secured to said receiver frame;

a bolt assembly slidably mounted within said receiver;

a feed mechanism feeding cartridges into said receiver frame through a breech opening formed in said receiver frame and ejecting spent cartridge casings from said receiver frame;

actuating means for causing said bolt assembly to move rearwardly to allow said ammunition to be fed into said receiver frame into a position aligned with said bolt assembly and further causing said bolt assembly to move so as to ram said round to ammunition into said chamber;

means locking said bolt in said position with said round seated in said firing chamber;

means locking said bolt during firing of said firearm and releasing said bolt for said rearward movement after firing of said round;

trigger means selectively operable to cause a round positioned in said chamber to be fired;

said means for actuating said bolt including power cylinder means including at least one piston and cylinder and including means for communicating gas pressure existing in said barrel bore to one side of said piston to create a force on said piston by said gas pressure generated in the bore by firing of said round;

said means further including a bolt extraction spring compressed by said piston and means for retracting said bolt by said compressed bolt extraction spring after firing of said cartridge and unlocking of said bolt assembly;

said feed mechanism including a feed slider moved rearwardly by said bolt assembly and returned by said means causing said bolt assembly to ram rounds of ammunition into said chamber, said feed slider including portions located to the front and the rear of said bolt extraction spring and portions extending therebetween, and further including means feeding said cartridges into said receiver frame by successive movements of said feed slider.

2. The weapon according to claim 1 wherein said means advancing said ammunition includes a parallel linkage comprised of a forward and rear strap, each pivotally mounted to said receiver frame at one end and each pivotally mounted at the other end to a connecting strap, and means producing in-and-out movement of said parallel linkage upon forward and rearward movement of said feed slider, respectively.

3. The weapon according to claim 2 wherein said means producing said in-and-out movement of said parallel linkage includes ram surfaces formed on said feed slider causing said movement upon forward and return movement of said feed slider.

4. The weapon according to claim 3 wherein said mechanism includes a pair of spaced feed trays mounted for reciprocation within said breech opening and means for advancing said ammunition rounds by reciprocation of said feed trays, and further including means for reciprocation of said feed trays in response to said in-and-out movement of said parallel linkage.

5. The weapon according to claim 4 wherein said means for reciprocating said feed trays comprises a feed tray operator fork positioned intermediate said connecting strap and said receiver frame, said feed tray operator fork having fingers slidably received within openings formed in said feed trays.

6. The weapon according to claim 5 wherein said means for actuating said bolt includes a carriage slidably mounted in said receiver to move under the urging of said at least one piston to compress said bolt extraction spring, and further including latching means securing said carriage against forward movement upon a predetermined extent of rearward travel, said latching means including means releasing said carriage after said bolt assembly has been moved rearwardly by said bolt extraction spring, said feed mechanism further including spring means creating a spring force in response to rearward movement of said feed slider and outward movement of said parallel linkage, and means for exerting said spring force on said feed tray operator fork upon release of said carriage by said latching means, whereby said ammunition feed occurs at said point in said weapon cycle.

7. The weapon according to claim 6 wherein said spring means includes a wound spring carried by said parallel linkage and having converging end sections with divergent tips joined to said wound spring by intermediate sections, said carriage being formed with a catch tab located to pass between and force apart said converging end sections to be thereby latched, and wherein said release of said carriage is achieved by impact of said bolt assembly during rearward movement and resultant outward movement of said end sections, and wherein said feed mechanism includes means drivingly engaging said feed tray operator fork and said end sections to be thereby moved outwardly.

8. The weapon according to claim 7 wherein said end sections are positioned in a recess in said receiver frame, whereby said latching forces are transmitted into said receiver frame.

9. The weapon according to claim 1 wherein said bolt locking means comprises relatively movable bolt latching element, said latching element relatively movable with respect to said bolt so as in a first position to lock said bolt against sliding movement in said receiver frame and in a second position to allow said sliding movement of said bolt assembly in said receiver frame, means for momentarily releasing the pressure exerted on said bolt by said compressed bolt extraction spring during unlatching of said bolt assembly by movement of said relatively movable bolt latching element, said means for momentarily releasing said pressure comprising a high energy spring mounted in series with said bolt extraction spring, said high energy spring being compressed by said power cylinder assembly but substantially released during a reduction in pressure in said bore caused by movement of the ammunition bullet out of said barrel bore, said release of said high energy spring momentarily releasing the pressure exerted on said bolt assembly by said bolt extraction spring, and further including a portion of said feed slider interposed between said bolt retraction spring and said high energy spring, whereby said momentary release of said pressure is extended by acceleration and deceleration of said feed slider.

10. The weapon according to claim 6 wherein said feed slider front located portion comprises a front guide ring engaged by a shoulder of said bolt assembly to be moved rearwardly therewith and said rear located portion comprises a rear guide ring comprising said portion interposed between said bolt extraction spring and said high energy spring, said portions extending therebetween included in said means for operating said feed mechanism.

* * * * *